US010676307B1

(12) United States Patent
Mallahan, III

(10) Patent No.: US 10,676,307 B1
(45) Date of Patent: Jun. 9, 2020

(54) TAPE CUTTING DEVICE

(71) Applicant: Lee G. Mallahan, III, Bossier City, LA (US)

(72) Inventor: Lee G. Mallahan, III, Bossier City, LA (US)

( * ) Notice: Subject to any disclaimer, the term of this patent is extended or adjusted under 35 U.S.C. 154(b) by 0 days.

(21) Appl. No.: 15/926,444

(22) Filed: Mar. 20, 2018

Related U.S. Application Data

(63) Continuation-in-part of application No. 14/961,143, filed on Dec. 7, 2015, now Pat. No. 9,950,891.

(51) Int. Cl.
*B65H 35/00* (2006.01)
*B26F 3/02* (2006.01)

(52) U.S. Cl.
CPC ..... *B65H 35/0026* (2013.01); *B26F 3/02* (2013.01); *B65H 35/008* (2013.01)

(58) Field of Classification Search
CPC ... B26F 3/00; B26F 3/02; B65H 35/04; B65H 35/0026; B65H 35/0006; B65H 35/0013; B65H 35/002; B65H 35/0033; B65H 35/0073; B65H 35/008; B65H 16/00; B65H 16/02; B65H 16/06; Y10T 225/20; Y10T 225/238; Y10T 225/246; Y10T 225/247; Y10T 225/256; Y10T 225/257; Y10T 225/259; Y10T 225/26; Y10T 225/203; Y10T 225/225; Y10T 225/229; Y10T 156/1052; Y10T 156/12; Y10T 156/1365
See application file for complete search history.

(56) References Cited

U.S. PATENT DOCUMENTS 3,140,805 A * 7/1964 Seror ..... B65H 35/0026 225/66
6,763,988 B2 * 7/2004 Huang ..... B65H 35/002 225/43
8,443,862 B1 * 5/2013 Manabat ..... B65H 35/0026 156/527
8,991,674 B2 * 3/2015 Lee ..... B65H 35/0033 156/250

* cited by examiner

*Primary Examiner* — Phong H Nguyen
(74) *Attorney, Agent, or Firm* — R. Keith Harrison

(57) ABSTRACT

A tape cutting device includes a device frame adapted to ride along a tape roll. A blade housing may be carried by the device frame. The blade housing may have a pair of spaced-apart tape roll guides and a blade space between the tape roll guides. A blade actuating panel may be pivotally carried by the device frame. A tape cutting blade having a tape cutting edge may be carried by the blade actuating panel. The tape cutting blade may be selectively deployable between a retracted blade position in the blade space and an extended blade position with respect to the blade space in which the tape cutting blade engages the tape roll responsive to pivoting of the blade actuating panel on the device frame. A retaining mechanism may be carried by the tape cutting unit. The retaining mechanism may be adapted to secure the tape cutting unit on the tape roll.

12 Claims, 25 Drawing Sheets

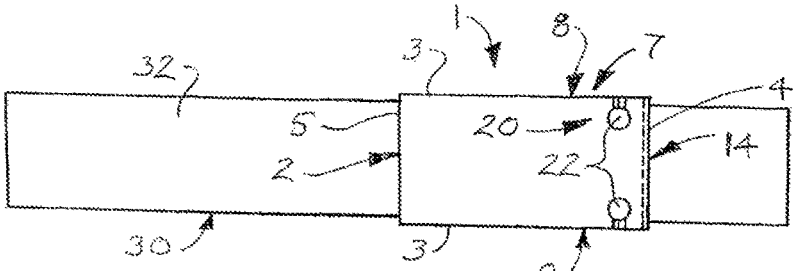
FIG. 8
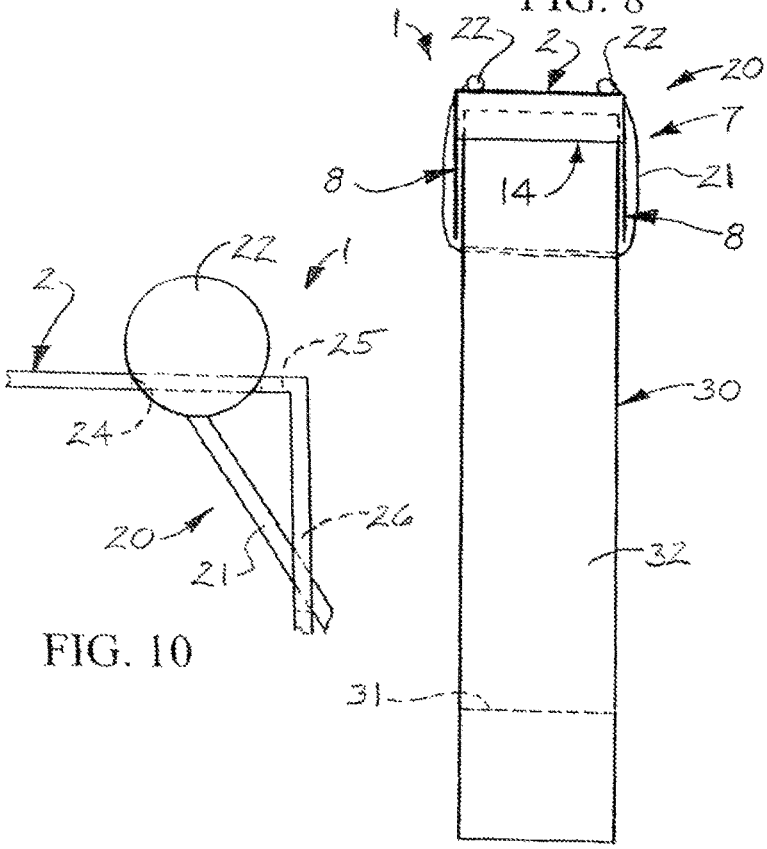
FIG. 10
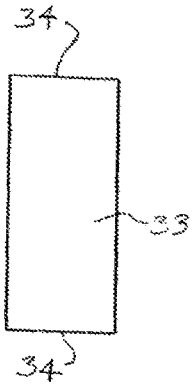
FIG. 11
FIG. 9
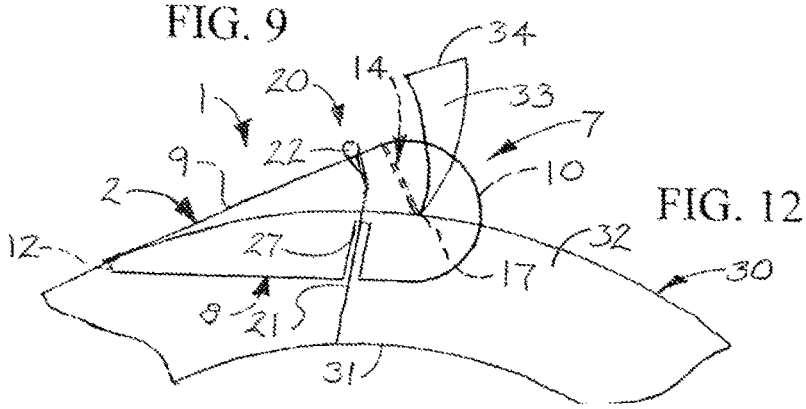
FIG. 12

TAPE CUTTING DEVICE

FIELD

Illustrative embodiments of the disclosure relate to devices for cutting adhesive tape. More particularly, illustrative embodiments of the disclosure relate to a roll-riding tape cutting device which can be used to cut tape segments of selected lengths and/or straight edges from adhesive tape wound on a tape roll.

BACKGROUND

Adhesive tape is commonly dispensed from a continuous tape roll having a cylindrical spool on which the tape is wound. In some applications, it may be desirable to obtain segments of tape having uniform lengths and/or straight edges. The tape segments are typically torn from the wound tape on the roll, however, with the result that the lengths and edges of the tape segments are often irregular, haphazard and non-uniform.

Accordingly, a roll-riding tape cutting device which can be used to cut tape segments of selected lengths and/or straight edges from adhesive tape wound on a tape roll may be desirable for some applications.

Illustrative embodiments of the disclosure are generally directed to a tape cutting device for cutting tape segments from tape wound on a tape roll. An illustrative embodiment of the tape cutting device includes a device frame adapted to ride along the tape roll. A blade housing may be carried by the device frame. The blade housing may have a pair of spaced-apart tape roll guides and a blade space between the tape roll guides. A blade actuating panel may be pivotally carried by the device frame. A tape cutting blade having a tape cutting edge may be carried by the blade actuating panel. The tape cutting blade may be selectively deployable between a retracted blade position in the blade space and an extended blade position with respect to the blade space responsive to pivoting of the blade actuating panel on the device frame. A retaining mechanism may be carried by the tape cutting unit. The retaining mechanism may be adapted to secure the tape cutting unit on the tape roll.

BRIEF DESCRIPTION OF THE DRAWINGS

Illustrative embodiments of the disclosure will now be described, by way of example, with reference to the accompanying drawings, in which:

FIG. 8 is a top view of an illustrative tape cutting device, secured on a roll of tape in exemplary application of the tape cutting device;

FIG. 9 is a front view of an illustrative tape cutting device, secured on a roll of tape in exemplary application of the tape cutting device;

FIG. 10 is an enlarged sectional view, taken along section line 10 in FIG. 9, of a portion of an illustrative tape cutting device, more particularly illustrating a retainer bead of an exemplary retainer mechanism seated in a bead seat in the tape cutting unit according to an exemplary technique for securing the tape cutting device on a tape roll;

FIG. 11 is a top view of an exemplary tape segment cut from a roll of tape in implementation of an illustrative tape cutting device;

FIG. 12 is a side view of an illustrative tape cutting device, secured on a tape roll (partially in section) in exemplary implementation of the device, more particularly illustrating tearing of a segment of tape from the tape roll;

DETAILED DESCRIPTION

Figure 1:
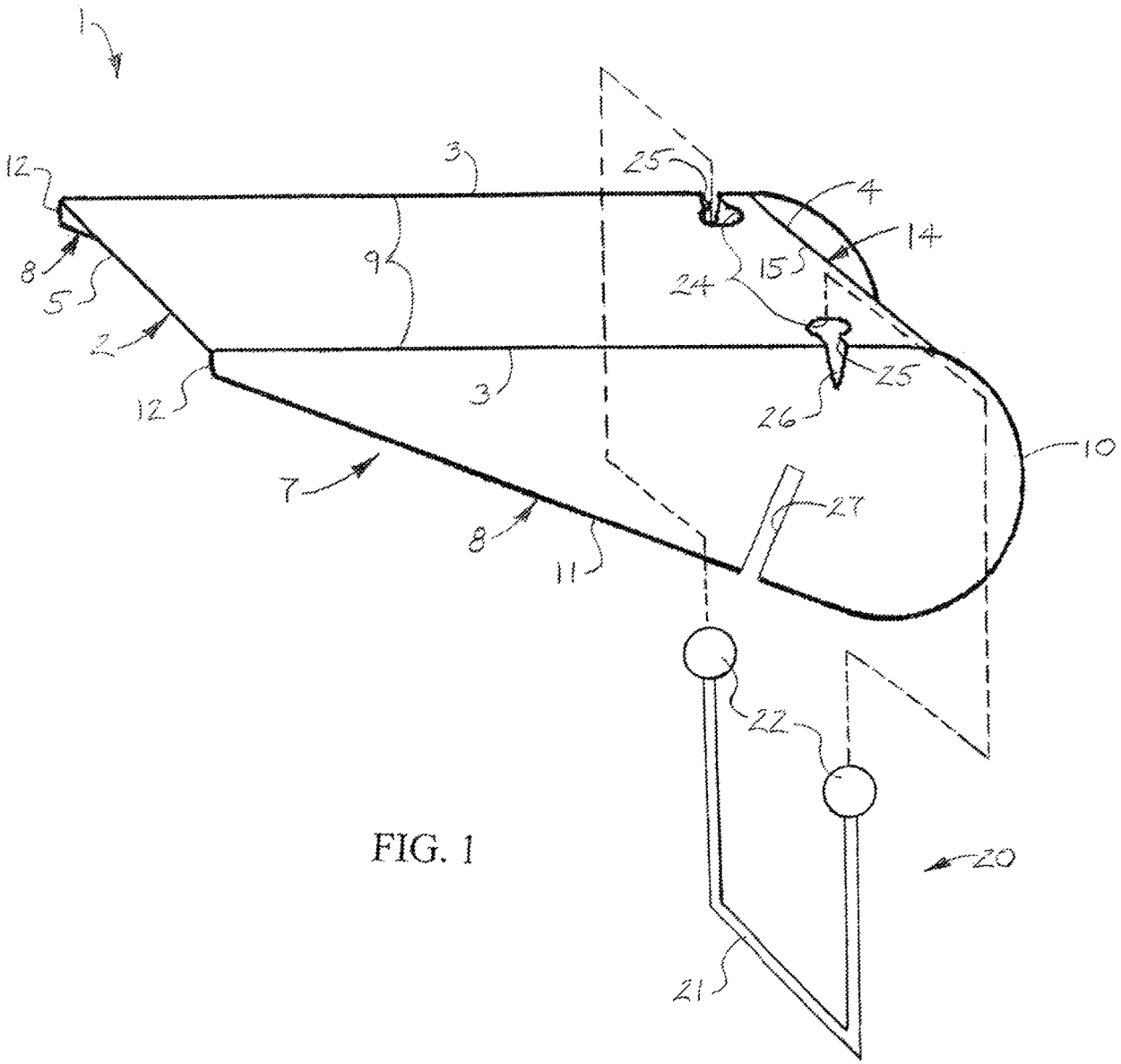
FIG. 1 is an exploded perspective view of an illustrative embodiment of the tape cutting device, with an exemplary tape cutting unit and an exemplary retainer mechanism which is suitable for securing the tape cutting unit on a roll of tape (not illustrated)
Figure 2:
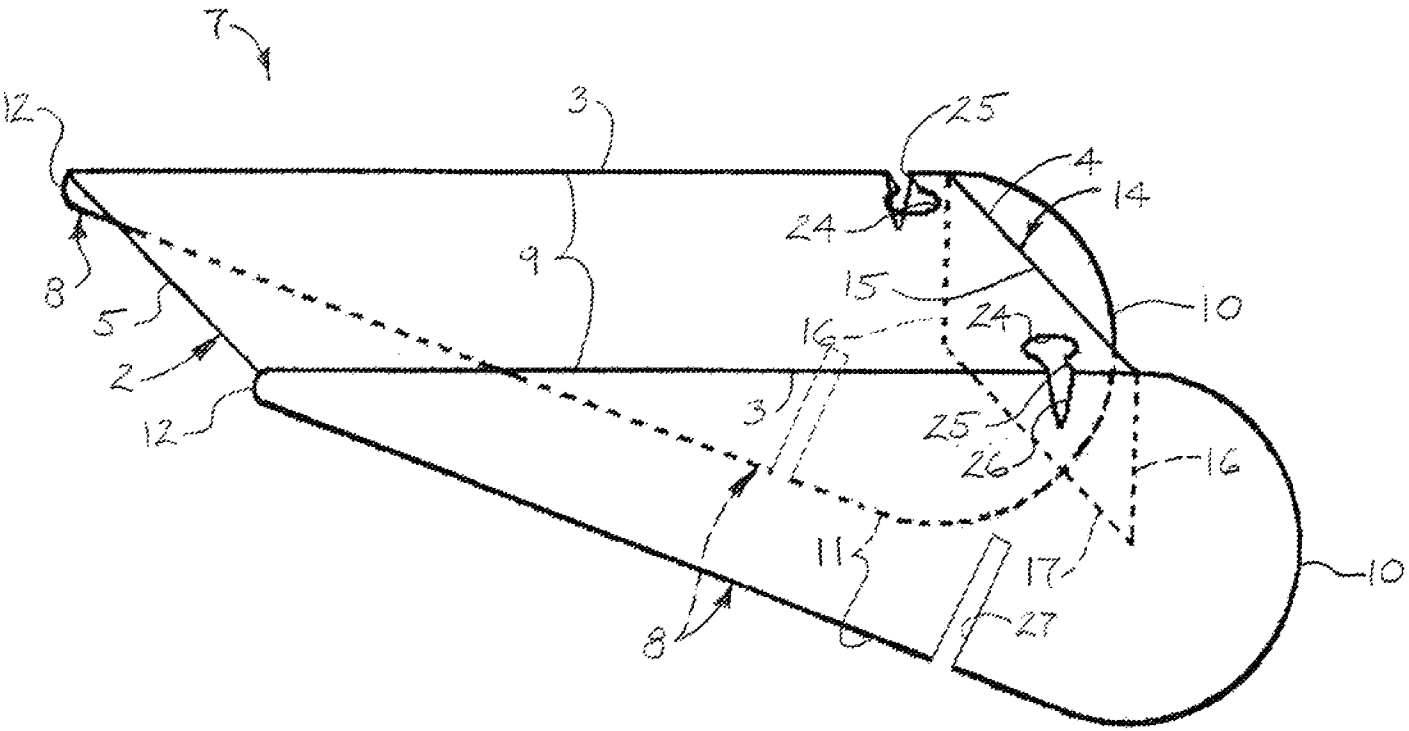
FIG. 2 is a perspective view of an exemplary tape cutting unit of a tape cutting device, with hidden components of the tape cutting unit illustrated in phantom lines.
Figure 3:
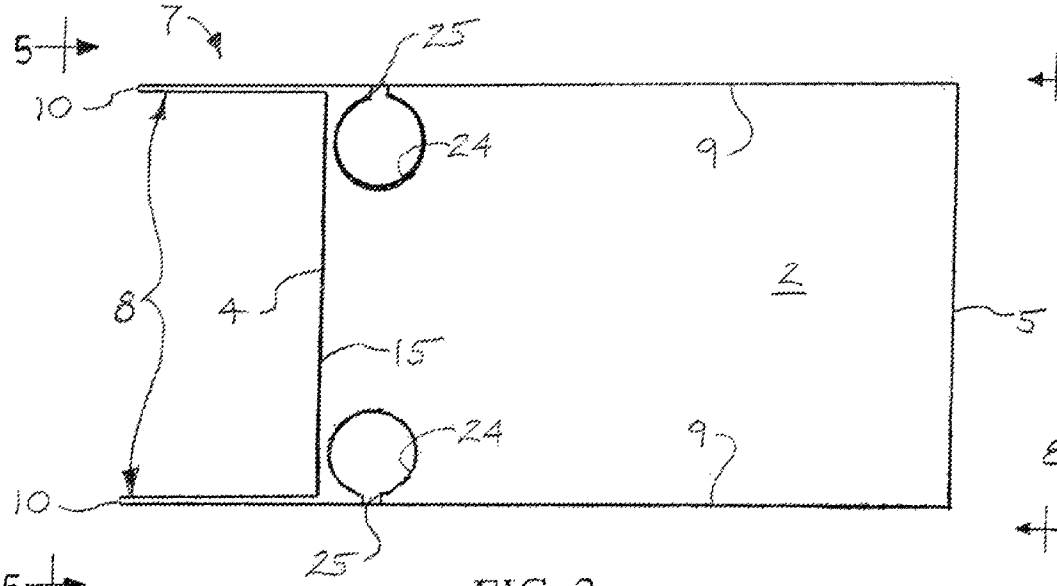
FIG. 3 is a top view of an exemplary tape cutting unit of a tape cutting device.
Figure 5:
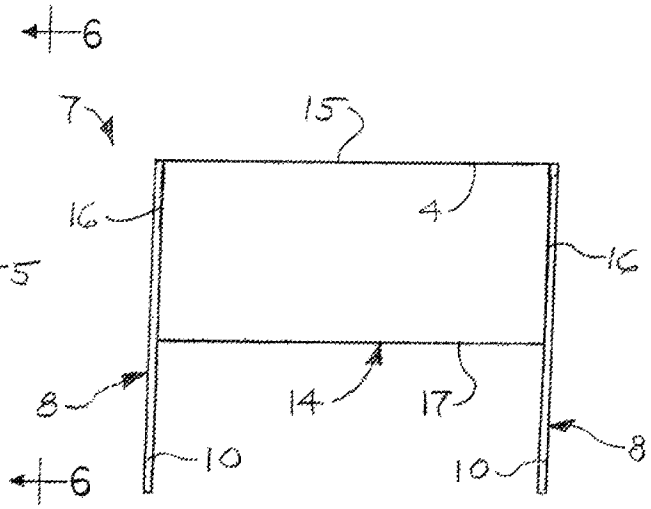
FIG. 5 is a front view, taken along section lines 5-5 in FIG. 3, of an exemplary tape cutting unit.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. As used herein, relative terms such as "front" and "rear" as used herein are intended for descriptive purposes only and are not necessarily intended to be construed in a limiting sense.

Referring initially to FIGS. 1-16 of the drawings, an illustrative embodiment of the tape cutting device is generally indicated by reference numeral 1. As illustrated in FIGS. 8-16 and will be hereinafter described, the tape cutting device 1 is adapted to be secured on a tape roll 30 which may be conventional and typically has a spool 31 on which is wound a continuous length of adhesive tape 32. The adhesive tape 32 may be masking tape, duct tape, packaging tape or any other type of commercially-available adhesive tape which is wound on and dispensed from a spool 31 for any of a variety of purposes. The tape cutting device 1 can be used to cut tape segments 33 (FIG. 11) of consistently selected uniform lengths and/or straight edges 34 from the tape 32 wound on the spool 31.

As illustrated in FIGS. 1-7, the tape cutting device 1 includes a tape cutting unit 7 and a retainer mechanism 20 which secures the tape cutting unit 7 on the tape roll 30. The tape cutting unit 7 may include a device panel 2. The device panel 2 may be generally rectangular with a pair of spaced-apart, parallel side panel edges 3 and a blade support edge 4 and a tape roll engaging edge 5 extending between the side panel edges 3 in parallel, spaced-apart relationship to each other.

A pair of spaced-apart tape roll guides 8 may extend from the respective side panel edges 3 of the device panel 2. The tape roll guides 8 may be disposed at a generally 90-degree angle with respect to the device panel 2 and in generally parallel, spaced-apart relationship to each other. Each tape roll guide 8 may have a straight panel attachment edge 9 which is joined to or continuous with the corresponding side panel edge 3 of the device panel 2. Each tape roll guide 8 may have a blade end guide edge 10 which may be generally semicircular and is continuous with the panel attachment edge 9 and protrudes beyond the blade support edge 4 of the device panel 2. A return guide edge 11 may be straight and is continuous with the blade end guide edge 10. A terminal guide edge 12 may be continuous with the return guide edge 11 and the panel attachment edge 9 at the tape roll engaging edge 5 of the device panel 2.

A tape cutting blade 14 extends from the blade support edge 4 of the device panel 2 and is disposed between the spaced-apart tape roll guides 8. The tape cutting blade 14 may be disposed at a generally 90-degree angle with respect to the device panel 2 and with respect to each of the tape roll guides 8. As particularly illustrated in FIGS. 2 and 5, the tape cutting blade 14 may be generally rectangular with a blade attachment edge 15 which is joined to or continuous with the blade support edge 4 of the device panel 2; a pair of spaced-apart, parallel blade side edges 16 which extend from the blade attachment edge 15 and may be engaged by the respective tape roll guides 8; and a tape cutting edge 17 which extends between the blade side edges 16 in spaced-apart, parallel relationship to the blade attachment edge 15. The tape cutting edge 17 may be tapered in cross-section.

Figure 7:
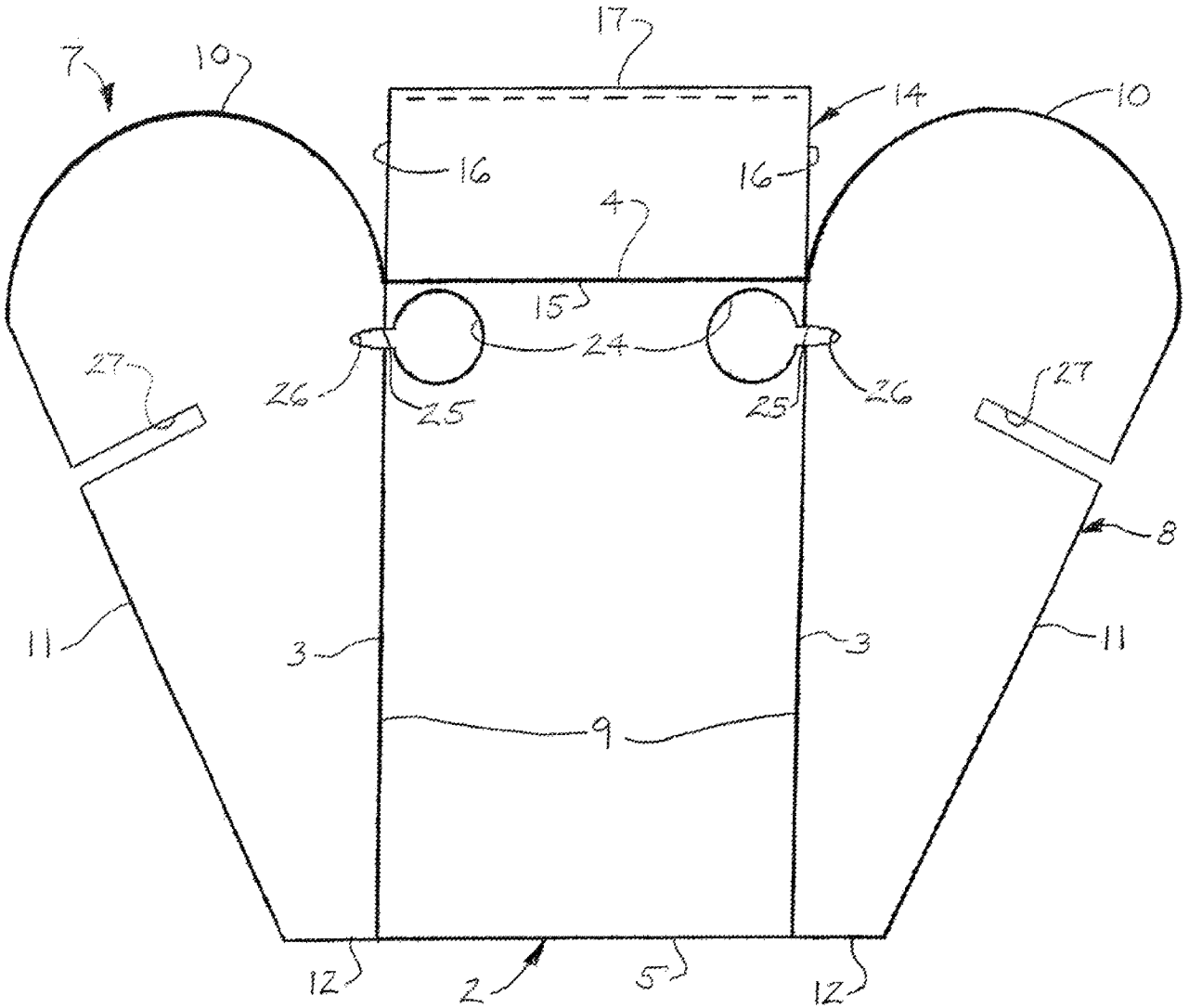
FIG. 7 is a top view of an exemplary unfolded tape cutting unit according to an illustrative embodiment of the tape cutting device.

The tape cutting unit 7 may be any material which is consistent with the functional requirements of the tape cutting device 1. Non-limiting examples of materials which are suitable for the purpose include aluminum, steel, high-grade plastics, composite materials and combinations thereof. The tape cutting unit 7 can be fabricated using any of a variety of fabrication techniques known by those skilled in the art including but not limited to casting, molding, machining, welding and soldering. As illustrated in FIG. 7, in some methods of fabrication, the device panel 2, the tape roll guides 8 and the tape cutting blade 14 of the tape cutting unit 7 may be cut or stamped flat from a sheet (not illustrated) of material such as aluminum, steel or composite material, for example and without limitation. The tape roll guides 8 may be folded along the respective side panel edges 3 and the tape cutting blade 14 may be folded along the blade support edge 4 of the device panel 2 to shape the tape cutting unit 7. In other methods of fabrication, the tape roll guides 8 and the tape cutting blade 14 may be fabricated separately and attached to the device panel 2 according to the knowledge of those skilled in the art.

Figure 13:
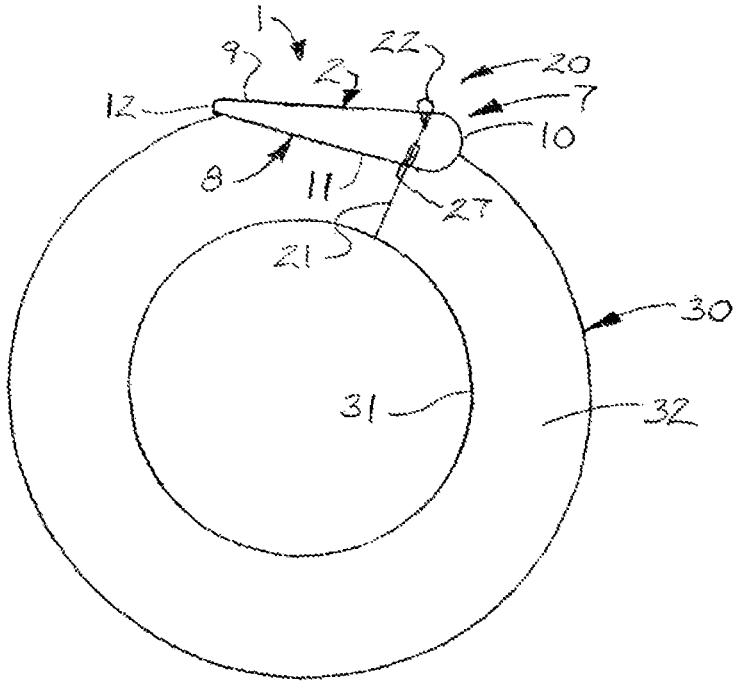
FIG. 13 is a side view of an illustrative tape cutting device, secured on a tape roll in exemplary implementation of the device.

As further illustrated in FIG. 1, the tape cutting device 1 may include a retainer mechanism 20 which secures the tape cutting unit 7 on the tape roll 30 (FIG. 13). In some embodiments, the retainer mechanism 20 may include an elongated, flexible and elastic retainer cord 21. Retainer members 22 may terminate the opposite ends of the retainer cord 21. The retainer members 22 may be beads, knots, washers or the like. A pair of spaced-apart retainer seats 24 may be provided in the device panel 2 of the tape cutting unit 7. A cord slit 25 communicates with and extends from each retainer seat 24 to the side panel edge 3 of the device panel 2. A cord notch 26 in the tape roll guide 8 communicates with the cord slit 25. A cord accommodation notch 27 may extend from the return guide edge 11 of each tape roll guide 8, at an angle toward the retainer seat 24. Accordingly, as illustrated in FIGS. 8-10, the retainer members 22 are seated and retained in the respective retainer seats 24 in the device panel 2. The retainer cord 21 extends through the cord notches 26 in the respective tape roll guides 8 and adjacent to the respective cord accommodation slots 27 through the spool 31 of the tape roll 30, engaging the inner surface of the spool 31. Thus, the retainer cord 21 of the retainer mechanism 20 maintains a secure and tight fit of the tape cutting unit 7 on the tape roll 30 throughout use of the tape cutting device 1, as will be hereinafter described.

As illustrated in FIGS. 8-16, in exemplary application of the tape cutting device 1, the tape cutting unit 7 is secured on the tape roll 30 by initially placing the spaced-apart tape roll guides 8 on opposite sides of the tape roll 30. The tape roll engaging edge 5 of the device panel 2 engages the outermost layer of the tape 32 which is wound on the spool 31 of the tape roll 30. The tape cutting edge 17 on the tape cutting blade 14 engages the outermost layer of tape 32 against the underlying layers of tape 32 on the tape roll 30. The retainer mechanism 20 secures the tape cutting unit 7 on the tape roll 30 by extension of the retainer cord 21 through the cord notches 26 and the spool 31 and seating of the retainer members 22 in the respective retainer seats 24 in the device panel 2.

The tape cutting unit 7 is slid along the tape roll 30 until the tape cutting blade 14 is located at a selected distance from the free end (not illustrated) of the tape 32, which distance corresponds to the desired length of the tape segment 33 to be cut from the tape 32. Manual pressure may be applied to the device panel 2 such that the tape cutting edge 17 of the tape cutting blade 14 crimps the tape 32. The free end of the tape 32 is next located and grasped, and the tape segment 33 which is to be removed is peeled from the underlying portion of the tape 32 wound on the spool 31. As it is removed from the underlying wound tape 32, the tape segment 33 is pulled against and across the tape cutting edge 17 of the tape cutting blade 14 such that the blade attachment edge 15 severs the tape segment 33 from the tape 32. As illustrated in FIG. 11, it will be appreciated by those skilled in the art that the blade attachment edge 15 of the tape cutting blade 14 cuts a straight edge 34 in the tape segment 33 as well as multiple tape segments 33 of selected and uniform or consistent length.

Figure 14:
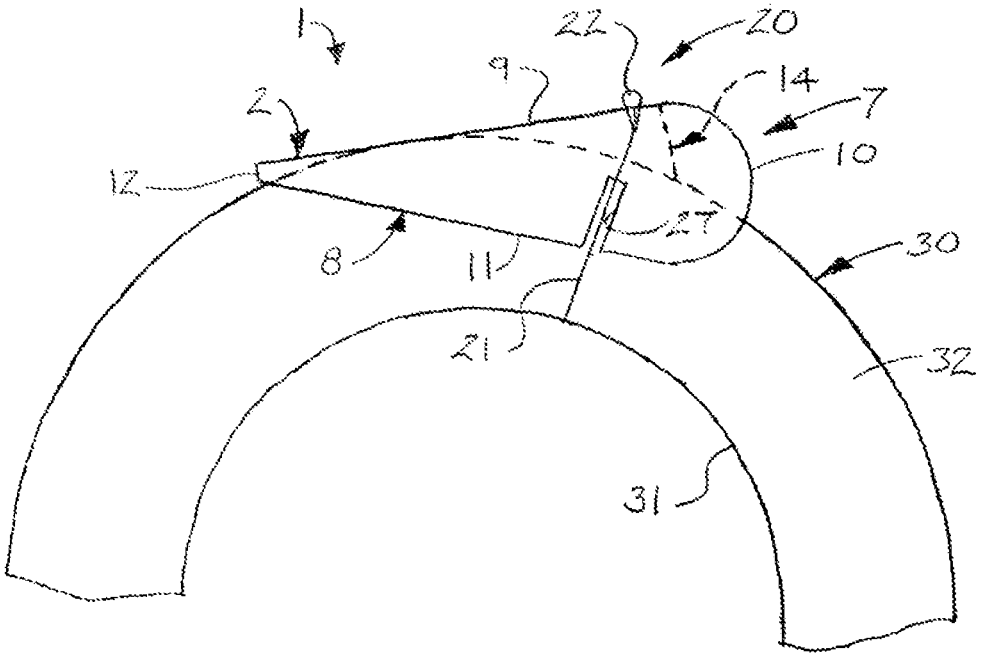
FIGS. 14-16 are side views of an illustrative tape cutting device secured on a tape roll (partially in section) in exemplary implementation of the device, with the retainer mechanism maintaining a tight fit of the device on the tape roll of decreasing diameter as the tape segments are progressively dispensed from the roll.
Figure 15:
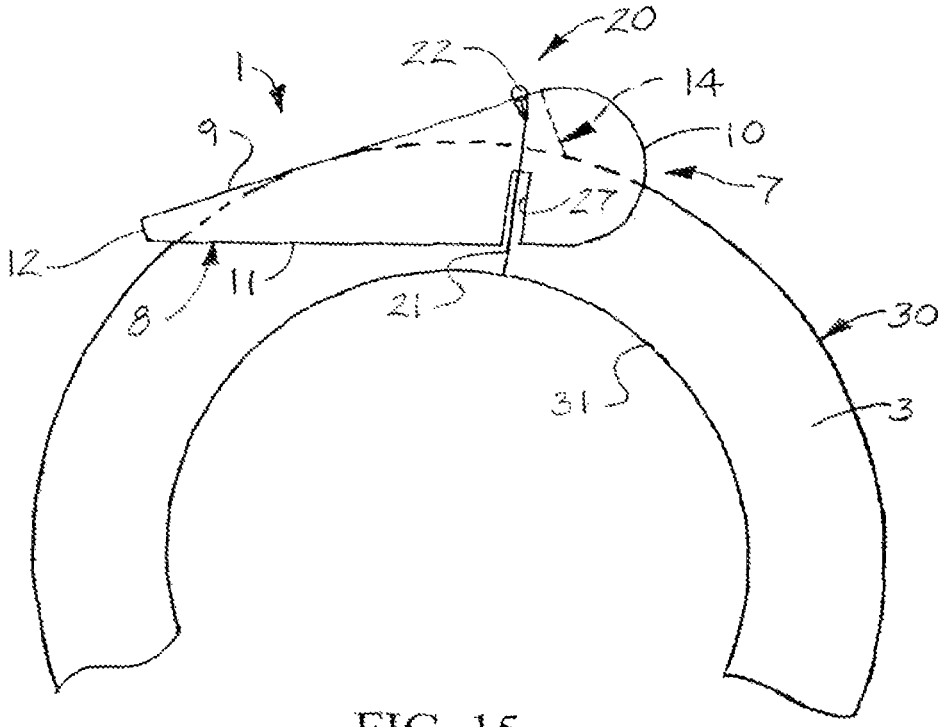
Figure 16:
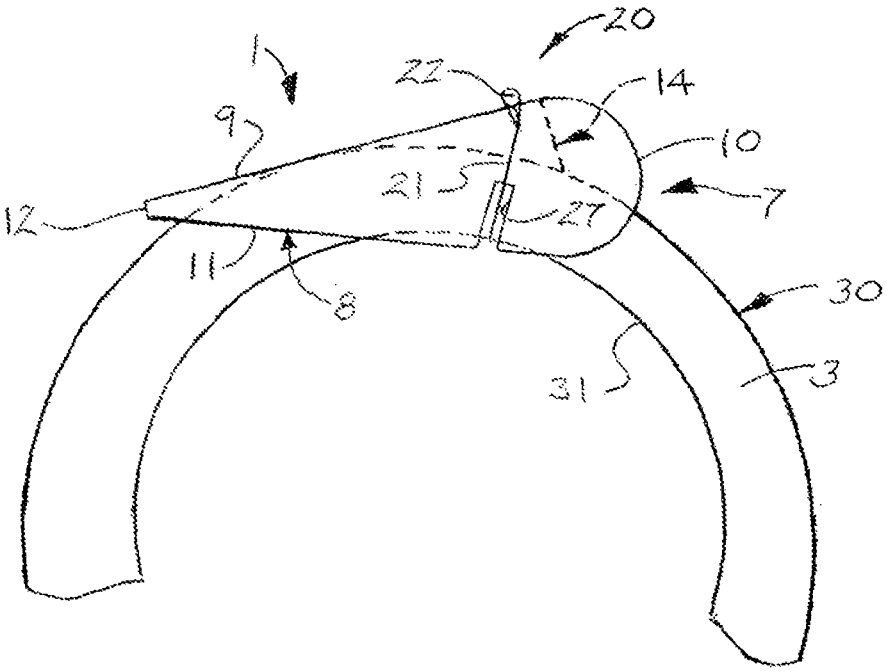

As the tape segments 33 are cut and dispensed from the tape roll 30, the tape cutting device 1 is pushed or "rides" along the tape roll 30 to position the tape cutting edge 17 of the tape cutting blade 14 at the selected positions along the tape 32 for cutting and dispensing of the tape segments 33 of selected length. Throughout use of the tape cutting device 1, the elastic retainer cord 21 of the retainer mechanism 20 is constantly in a contracted state and thus, continually maintains a secure and snug fit of the tape cutting unit 7 against the tape roll 30. Therefore, as the diameter of the tape roll 30 progressively decreases as a result of the tape 32 being gradually dispensed from the spool 31, as illustrated in FIGS. 14-16, the retainer cord 21 contracts and continues to snugly secure the tape cutting unit 7 on the tape roll 30 and prevents loosening of the tape cutting unit 7. As illustrated in FIG. 16, when the diameter of the tape roll 30 decreases to the point at which the spool 31 of the tape roll 30 recedes beyond the return guide edge 11 of each tape roll guide 8, the cord accommodation slots 27 accommodate the retainer cord 21 such that the retainer cord 21 continues to engage the inner surface of the spool 31. When all of the tape 32 has been dispensed from the spool 31, the tape cutting unit 7 can be removed from the spool 31 by disengaging the retainer members 22 from the respective retainer seats 24 in the device panel 2 and removing the retainer cord 21. The tape cutting device 1 can be subsequently used in a similar manner on a fresh tape roll 30.

Figure 17:
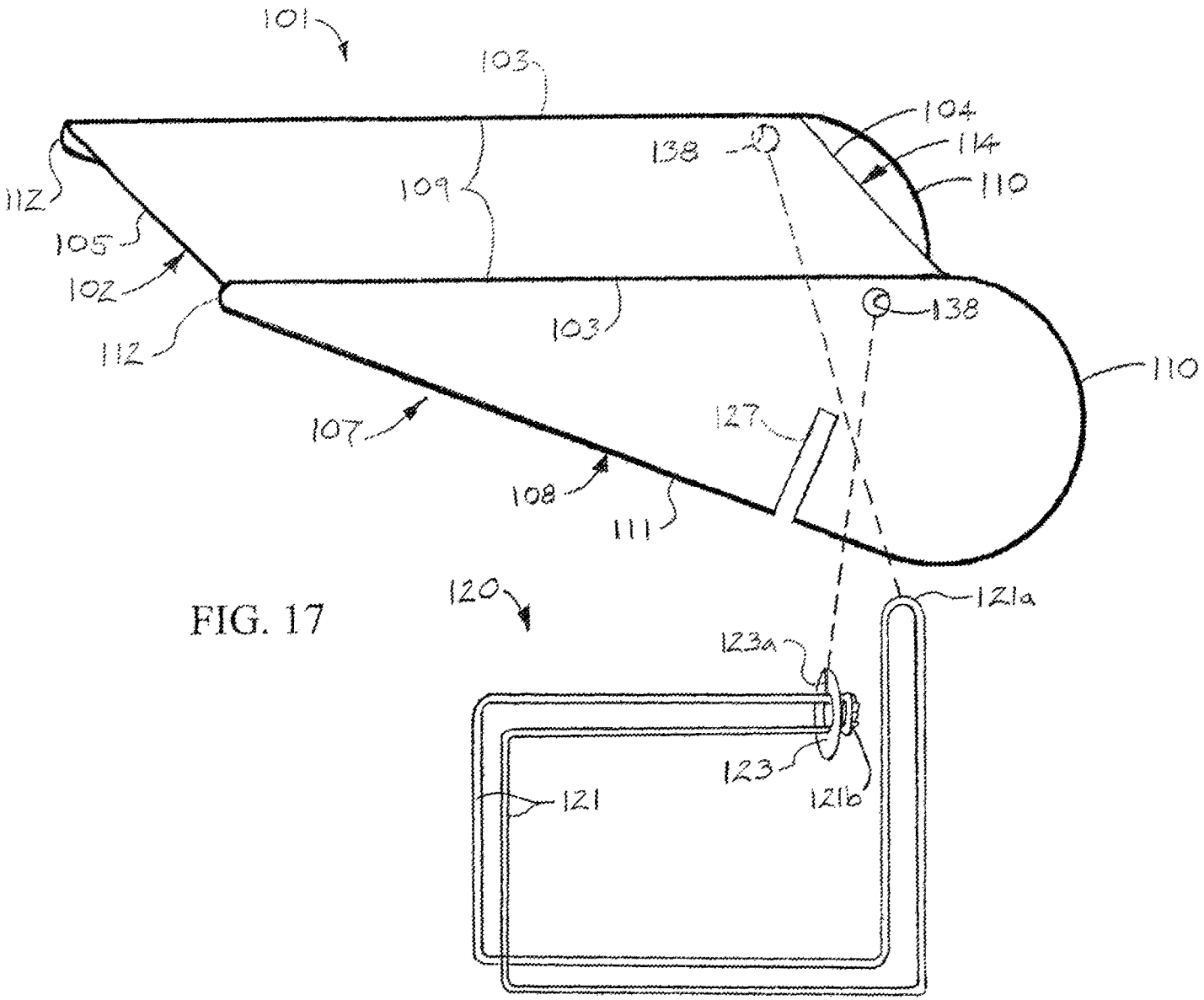
FIG. 17 is an exploded perspective view of an illustrative tape cutting device, with an alternative exemplary retainer mechanism which is suitable for securing the tape cutting unit of the tape cutting device on a roll of tape.
Figure 17A:
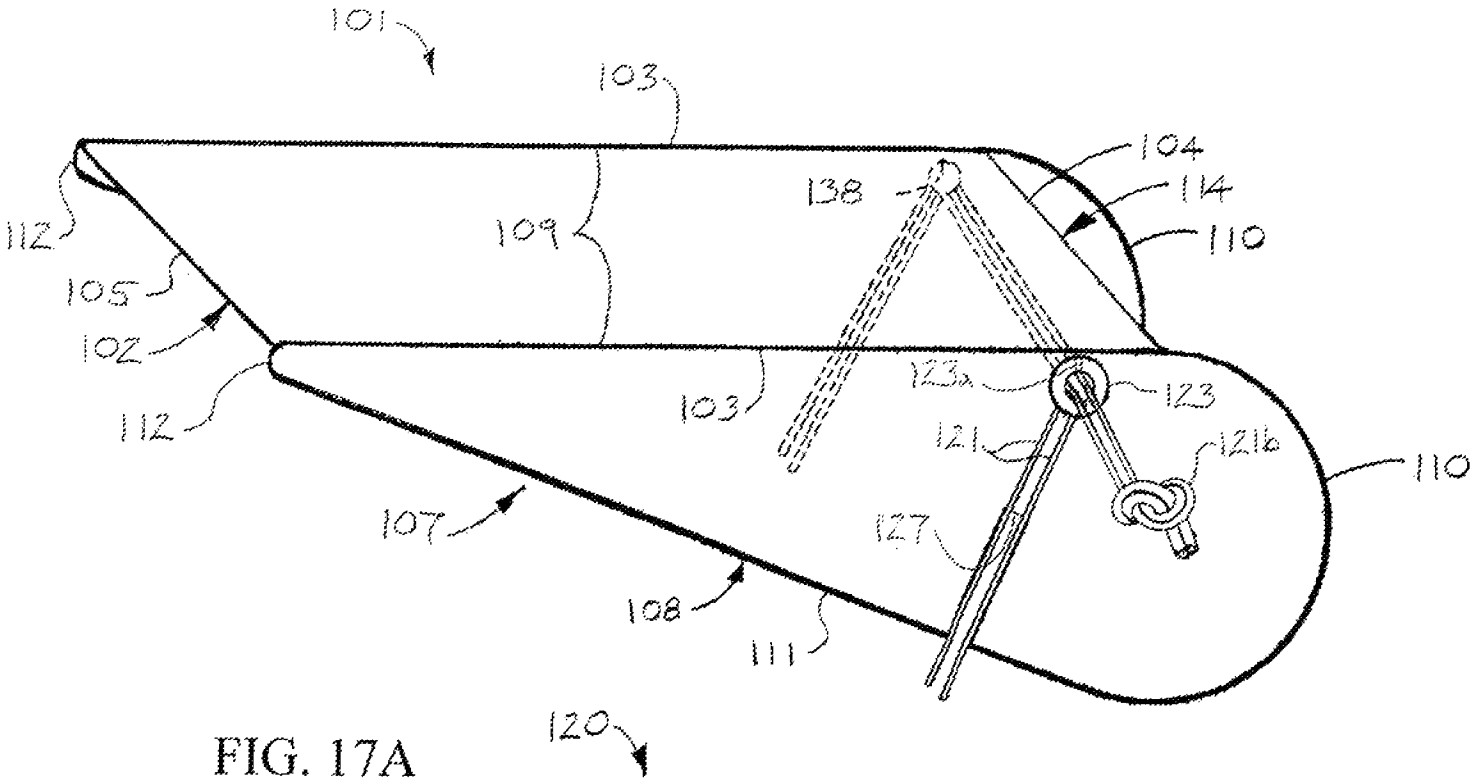
FIG. 17A is a perspective view of an illustrative tape cutting device with the exemplary retainer mechanism illustrated in FIG. 17.

Referring next to FIGS. 17 and 17A of the drawings, an alternative illustrative embodiment of the tape cutting device is generally indicated by reference numeral 101. In the tape cutting device 101 of FIG. 17, elements which are analogous to the respective elements of the tape cutting device 1 that was heretofore described with respect to FIGS. 1-16 are designated by the same numeral in the 101-199 series. An exemplary retainer mechanism 120 may include an elastic retainer cord 121 having a cord loop 121*a*. A cord knot 121*b* may be tied in the ends of the retainer cord 121 and retains a retainer washer 123 on the retainer cord 121. The washer 123 may have a washer slot 123*a*. A pair of spaced-apart cord openings 138 may extend through the respective tape roll guides 108. Accordingly, the retainer cord 121 is extended through the cord openings 138 and through the spool 31 (FIG. 13) of the tape roll 30. The cord loop 121*a* receives and engages the retainer washer 123, which retains the retainer cord 121 around the tape roll 30 such that the tape cutting unit 7 is retained on the spool 31. The retainer cord 121 may be pulled through the retainer washer 123 by grasping the cord knot 121*b* to tighten the retainer cord 121 as the tape roll 30 decreases in diameter during the course of use. Application of the tape cutting device 101 may be as was heretofore described with respect to the tape cutting device 1 in FIGS. 1-16.

Figure 18:
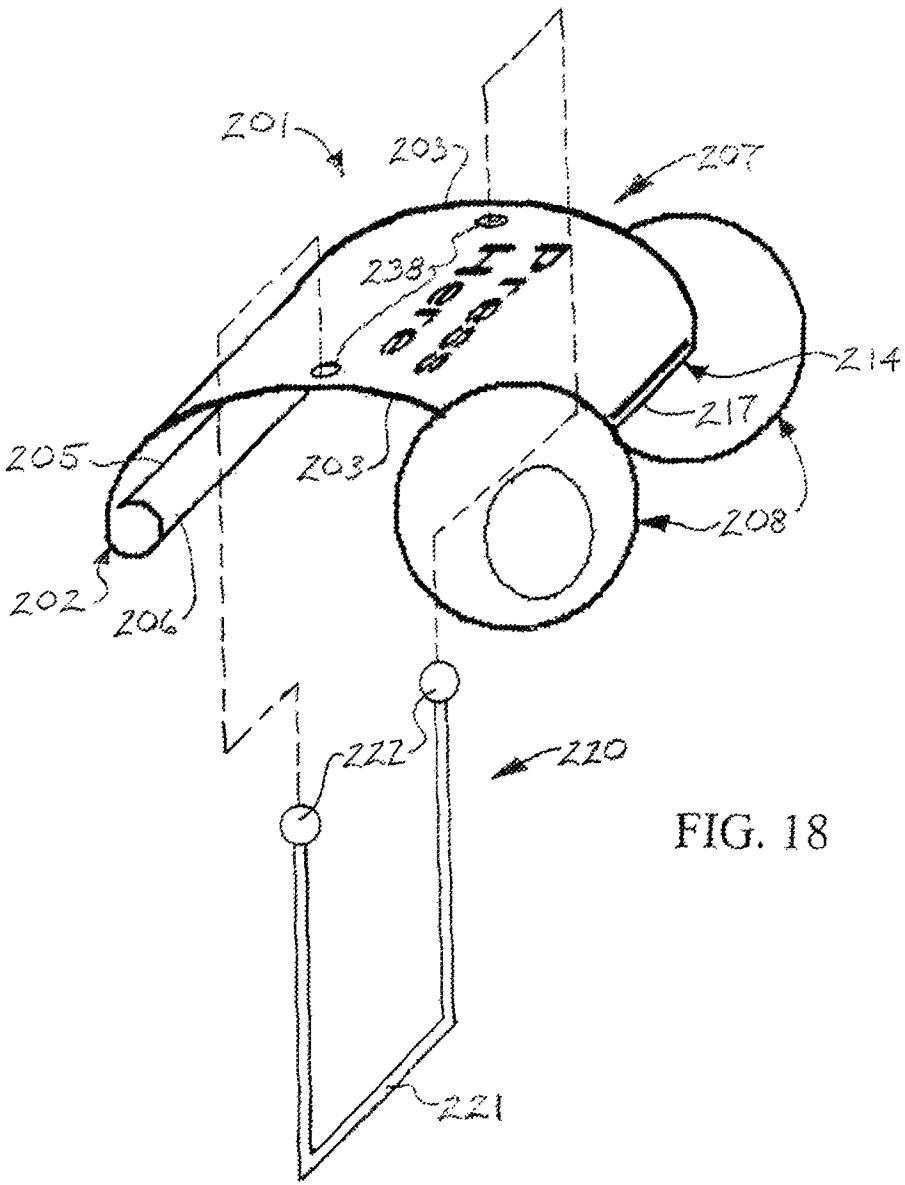
FIG. 18 is an exploded perspective view of an alternative illustrative embodiment of the tape cutting device.

Referring next to FIG. 18 of the drawings, another alternative illustrative embodiment of the tape cutting device is generally indicated by reference numeral 201. In the tape cutting device 201 of FIG. 18, elements which are analogous to the respective elements of the structure 1 that was heretofore described with respect to FIGS. 1-16 are designated by the same numeral in the 201-299 series. The device panel 202 of the tape cutting unit 207 may be generally curved with a tape roll engaging roll 206 at the tape wall engaging edge 205. A pair of spaced-apart circular tape roll guides 208, each of which may be circular, may be provided on the respective side panel edges 203 of the device panel 202. A tape cutting blade 214 has a tape cutting edge 217 which corresponds to a front edge of the device panel 202 and extends between the tape roll guides 208.

A retainer mechanism 220 is adapted to secure the tape cutting unit 207 on a tape roll 30 (FIGS. 8-16). In some embodiments, the retainer mechanism 220 may include an elastic retainer cord 221 terminated by a pair of retainer members 222. A pair of spaced-apart cord openings 238 may be provided in the device panel 202. Accordingly, the retainer members 222 are seated and retained in the respective cord openings 238 in the device panel 202. The retainer cord 221 extends through the cord openings 238 in the device panel 202 and through the spool 31 of the tape roll 30, engaging the inner surface of the spool 31. In other embodiments, the retainer mechanism 220 may have alternative designs which are suitable for the purpose of securing the tape cutting unit 207 on the tape roll 30. The tape roll engaging roll 206 of the device panel 202 engages the tape roll 30, and the tape roll guides 208 are positioned on opposite sides of the tape roll 30. Application of the tape cutting device 101 may be as was heretofore described with respect to the tape cutting device 1 in FIGS. 8-16. The retainer cord 221 of the retainer mechanism 220 maintains a secure and tight fit of the tape cutting unit 207 on the tape roll 30 throughout use of the tape cutting device 201, as was heretofore described with respect to the tape cutting device 1.

Figure 19:
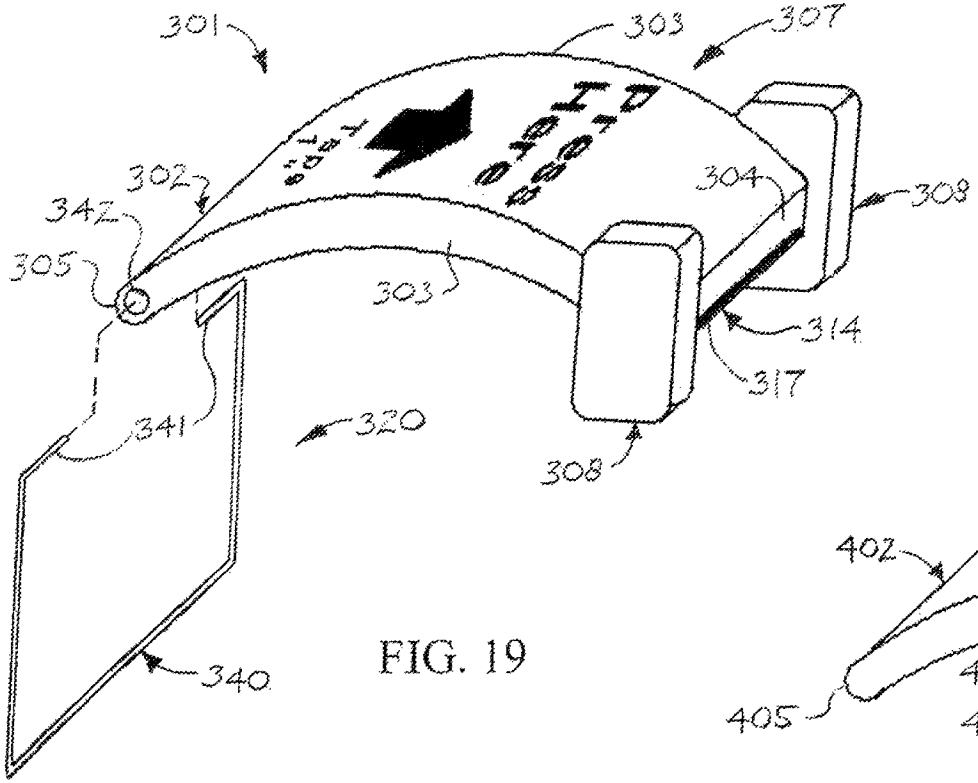
FIG. 19 is an exploded perspective view of another illustrative embodiment of the tape cutting device.
Figure 22:
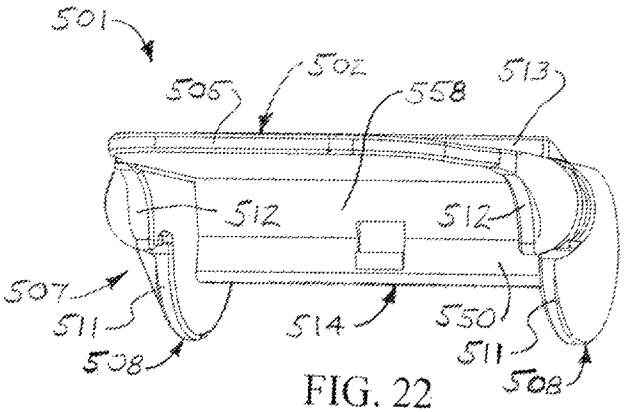
FIG. 22 is a rear perspective view of the tape cutting unit illustrated in FIG. 21.
Figure 21:
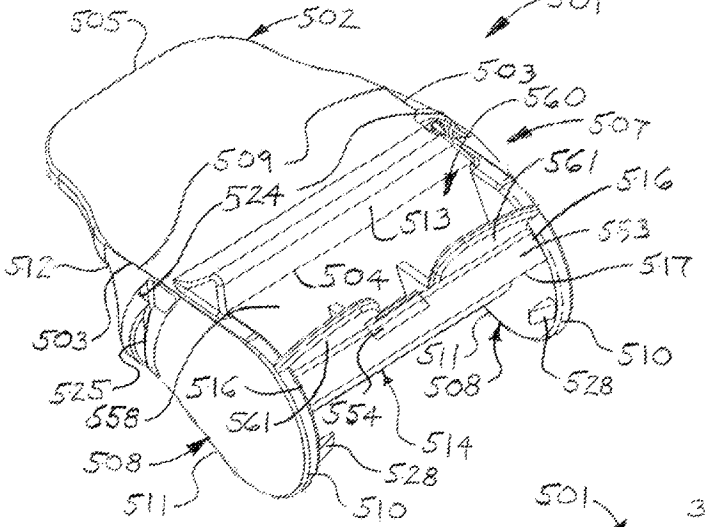
FIG. 21 is a front perspective view of a typical tape cutting unit of another alternative illustrative embodiment of the tape cutting device.
Figure 23:
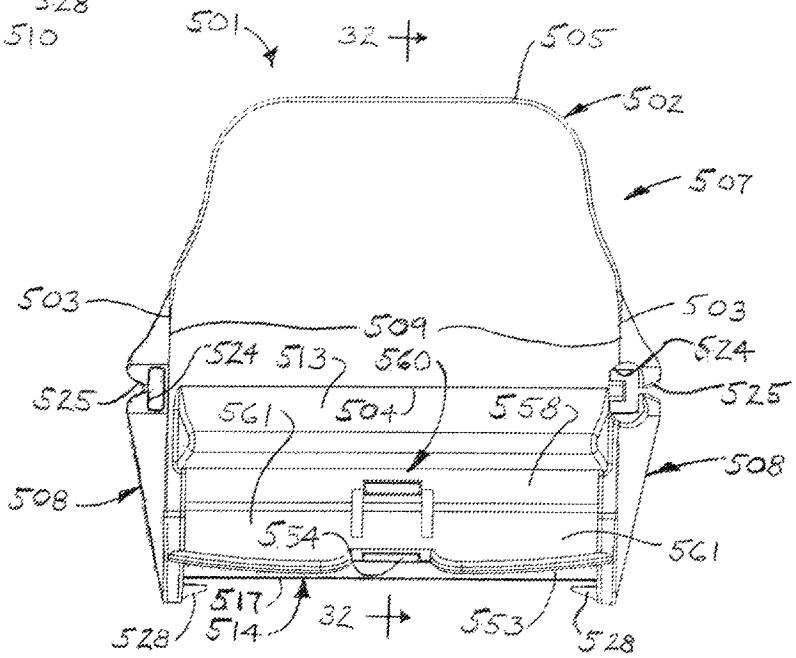
FIG. 23 is a top view of the tape cutting unit illustrated in FIG. 21.

Referring next to FIG. 19 of the drawings, another alternative illustrative embodiment of the tape cutting device is generally indicated by reference numeral 301. In the tape cutting device 301 of FIG. 19, elements which are analogous to the respective elements of the tape cutting device 1 that was heretofore described with respect to FIGS. 1-16 are designated by the same numeral in the 301-399 series. The device panel 302 of the tape cutting device 301 may be generally curved. A pair of spaced-apart, block-shaped tape roll guides 308 may be provided on the respective side panel edges 303 of the device panel 302. A tape cutting blade 314 has a tape cutting edge 317 which corresponds to a front edge of the device panel 302 and extends between the tape roll guides 308.

An exemplary retainer mechanism 320 of the tape cutting device 301 may include a retainer wire 340 having a pair of spaced-apart and inwardly-facing insertion ends 341. A pair of retainer wire openings 342 may be provided in the respective side panel edges 303 of the device panel 302. The retainer wire openings 342 are adapted to receive the respective insertion ends 341 of the retainer wire 340. Accordingly, the tape cutting unit 307 is secured on a tape roll 30 (FIGS. 8-16) by initially extending the retainer wire 340 through the spool 31 of the tape roll 30 and then inserting the insertion ends 341 of the retainer wire 340 into the respective retainer wire openings 342. The tape roll engaging edge 305 of the device panel 302 engages the tape roll 30, and the tape roll guides 308 are positioned on opposite sides of the tape roll 30. The retainer wire 340 of the retainer mechanism 320 maintains a secure and tight fit of the tape cutting unit 307 on the tape roll 30 throughout use of the tape cutting device 301, as was heretofore described with respect to the tape cutting device 1. In other embodiments, the retainer mechanism 320 may have alternative designs which are suitable for the purpose of securing the tape cutting unit 307 on the tape roll 30.

Figure 20:
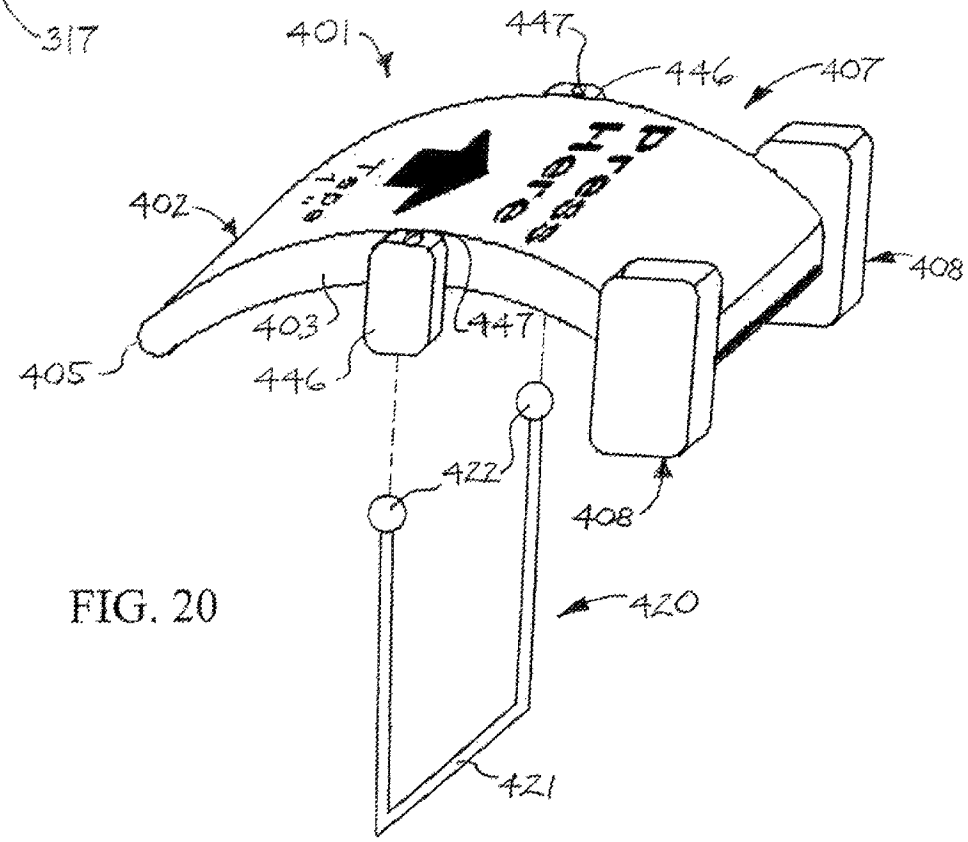
FIG. 20 is an exploded perspective view of still another illustrative embodiment of the tape cutting device.

Referring next to FIG. 20 of the drawings, another alternative illustrative embodiment of the tape cutting device is generally indicated by reference numeral 401. In the tape cutting device 401 of FIG. 20, elements which are analogous to the respective elements of the tape cutting device 301 that was heretofore described with respect to FIG. 19 are designated by the same numeral in the 401-499 series. An exemplary retainer mechanism 420 which secures the tape cutting unit 407 to a tape roll 30 may include a pair of spaced-apart retainer mount members 446. A cord opening 447 may extend through each retainer mount member 446. A retainer cord 421 which terminates in a pair of retainer members 422 extends through and is retained in each cord opening 447 as the retainer members 422 seat on the respective retainer mount members 446. The retainer cord 421 extends through the spool 31 of the tape roll 30, engaging the inner surface of the spool 31. In other embodiments, the retainer mechanism 420 may have alternative designs which are suitable for the purpose of securing the tape cutting unit 407 on the tape roll 30. The tape roll engaging edge 405 of the device panel 402 engages the tape roll 30, and the tape roll guides 408 are positioned on opposite sides of the tape roll 30. Application of the tape cutting device 401 may be as was heretofore described with respect to the tape cutting device 1 in FIGS. 8-16. The retainer cord 421 of the retainer mechanism 420 maintains a secure and tight fit of the tape cutting unit 407 on the tape roll 30 throughout use of the tape cutting device 401, as was heretofore described with respect to the tape cutting device 1.

Referring next to FIGS. 21-36D of the drawings, another alternative illustrative embodiment of the tape cutting device is generally indicated by reference numeral 501. In the tape cutting device 501 of FIGS. 21-36D, elements which are analogous to the respective elements of the tape cutting device 1 that was heretofore described with respect to FIGS. 1-16 are designated by the same numerals in the 501-599 series. Unless otherwise noted, the same descriptions which were heretofore applied to the various embodiments of the tape cutting device in FIGS. 1-20 may also apply to the tape cutting device 501.

A thumb flange 513 may protrude from the device panel 502 along the blade support edge 504 of the device panel 502. A rear blade mount panel 558 may extend along and angle from the blade support edge 504 between the tape roll guides 508. A front blade mount panel 559 may extend along and angle from the rear blade mount panel 558 between the tape roll guides 508. At least one finger guard 561 may protrude from the front blade mount panel 559. A panel gap 560, typically having a V-shape or U-shape in cross-section (FIG. 32), may be formed by and between the rear blade mount panel 558 and the front blade mount panel 559.

Figure 25:
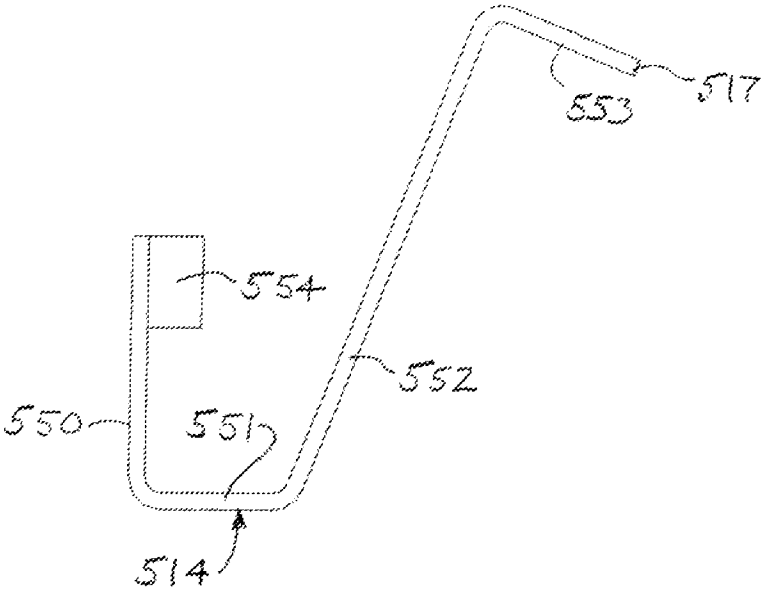
FIG. 25 is a side view of the tape cutting blade illustrated in FIG. 24.
Figure 24:
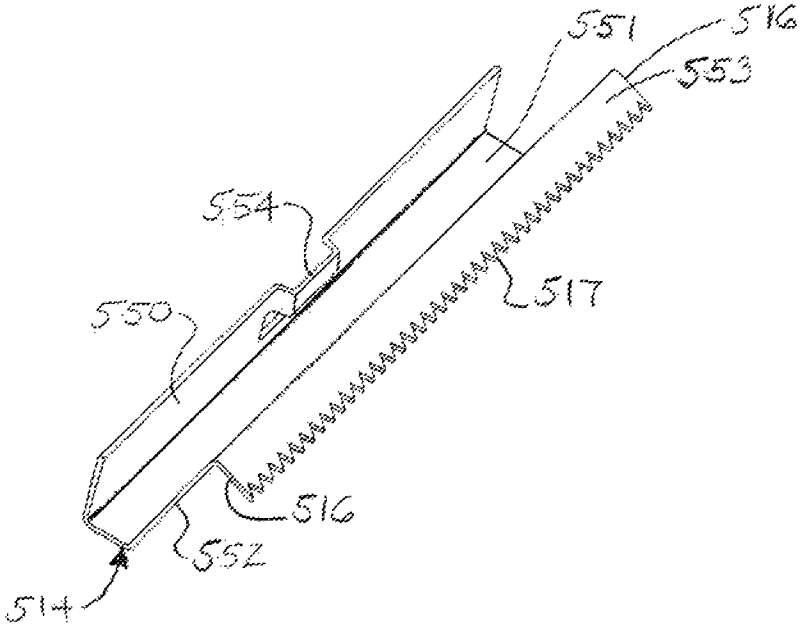
FIG. 24 is a front perspective view of a typical tape cutting blade of the tape cutting unit illustrated in FIG. 21.
Figure 26:
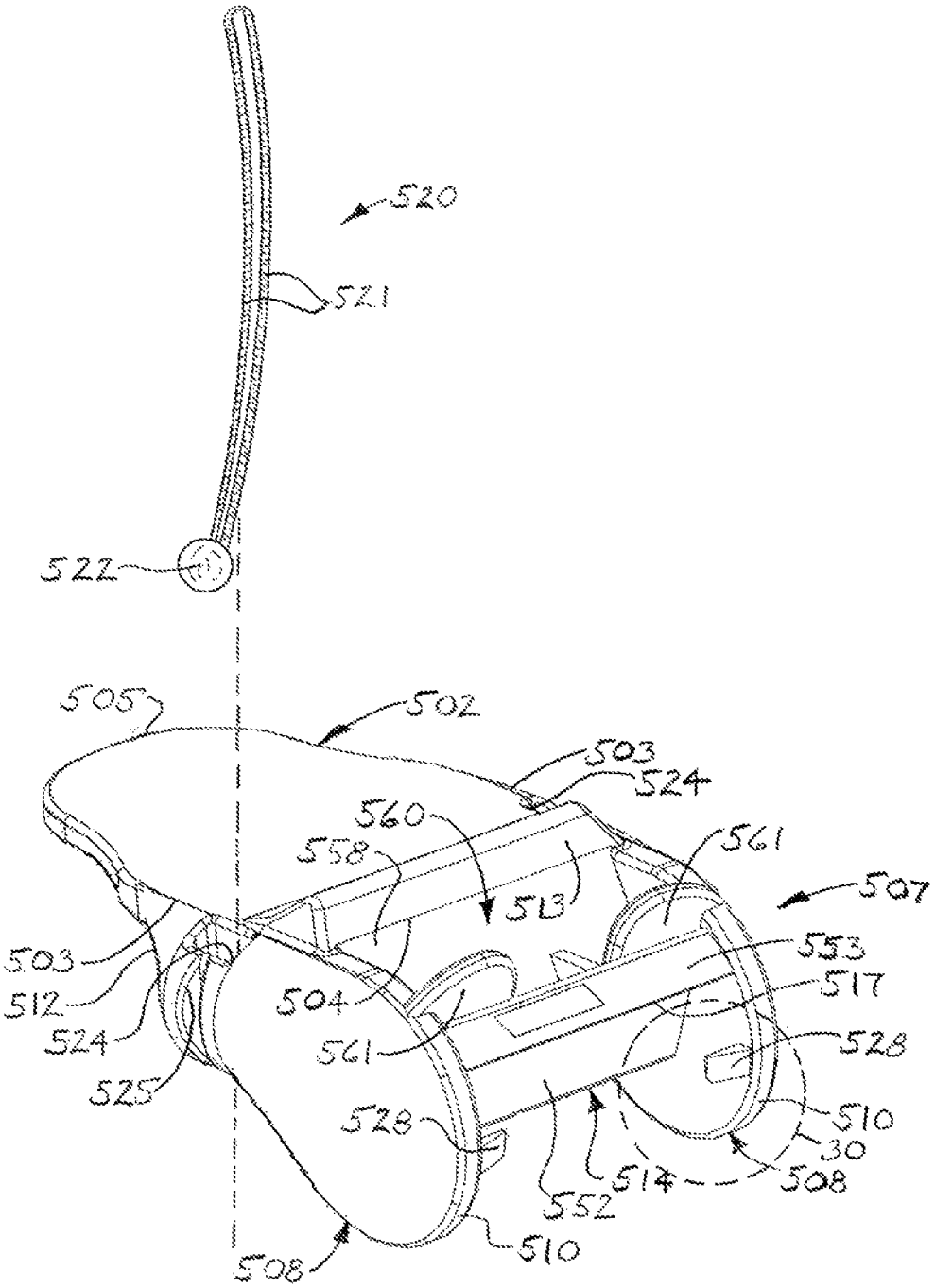
FIG. 26 is an exploded perspective view of the tape cutting unit illustrated in FIG. 21 with a typical retainer mechanism according to the illustrative tape cutting device.

The tape cutting blade 514 may be mounted on the rear blade mount panel 558 and the front blade mount panel 559. As illustrated in FIGS. 24 and 25, in some embodiments, the tape cutting blade 514 may include a rear blade mount portion 550 typically having a blade mount tab 554. A spanning blade portion 551 may extend from the rear blade mount portion 550. A front blade mount portion 552 may extend from the spanning blade portion 551. A tape cutting portion 553, having a tape cutting edge 517, may extend from the front blade mount portion 552. In some embodiments, the tape cutting edge 517 may be serrated. In other embodiments, the tape cutting edge 517 may be non-serrated. In some embodiments, the tape cutting portion 553 may be oriented at an angle of about 70-100 degrees with respect to the front blade mount portion 552 of the tape cutting blade 514.

Figure 32:
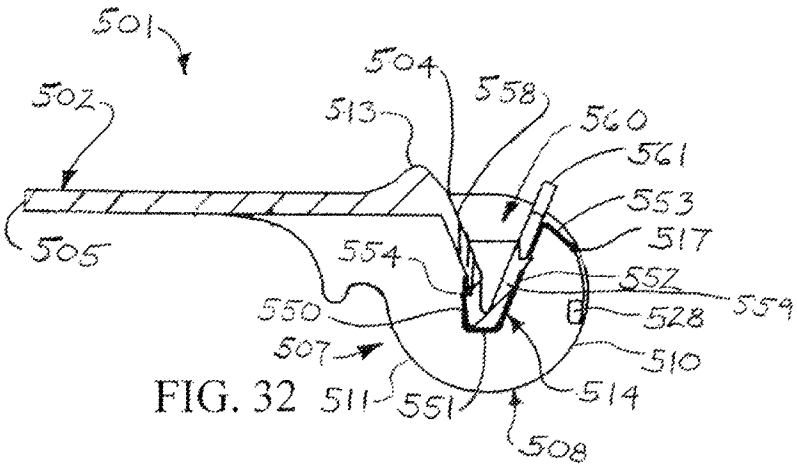
FIG. 32 is a longitudinal sectional view, taken along section lines 32-32 in FIG. 23.

As illustrated in FIG. 32, the tape cutting blade 514 may be mounted to the tape cutting unit 507 by snap attachment of the rear blade mount portion 550 to the rear blade mount panel 558 typically at the blade mount tab 554 and by similar attachment of the front blade mount portion 552 to the front blade mount panel 559. The spanning blade portion 551 of the tape cutting blade 514 may extend beneath the junction between the rear blade mount panel 558 and the front blade mount panel 559. The tape cutting portion 553 of the tape cutting blade 514 extends typically at an acute angle to the front blade mount portion 552 and may span the tape roll guides 508.

Figure 28:
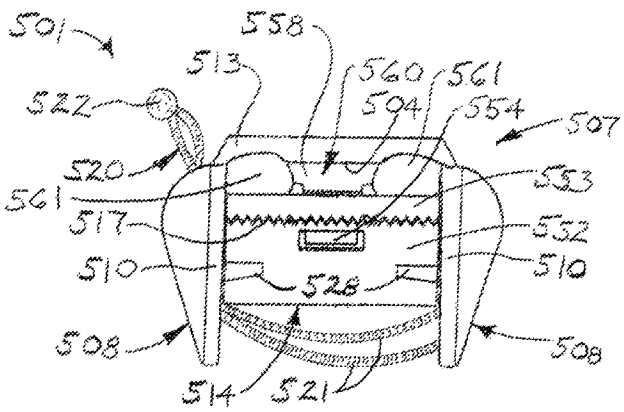
FIG. 28 is a front view of the illustrative tape cutting device illustrated in FIG. 27.
Figure 27:
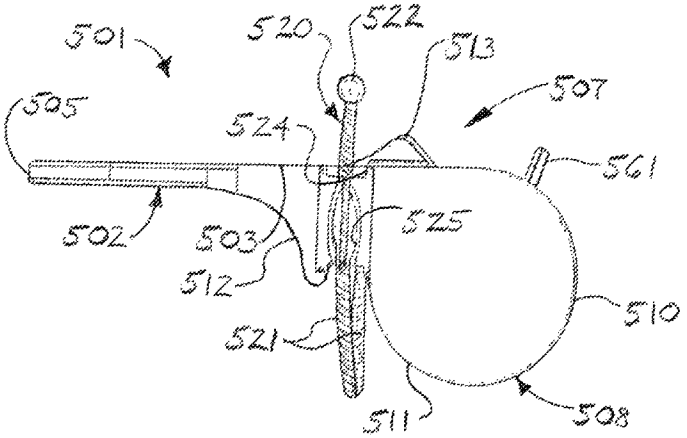
FIG. 27 is a left side view of the illustrative tape cutting device illustrated in FIG. 26, with the retainer mechanism deployed in a fastened position on the tape cutting unit.
Figure 29:
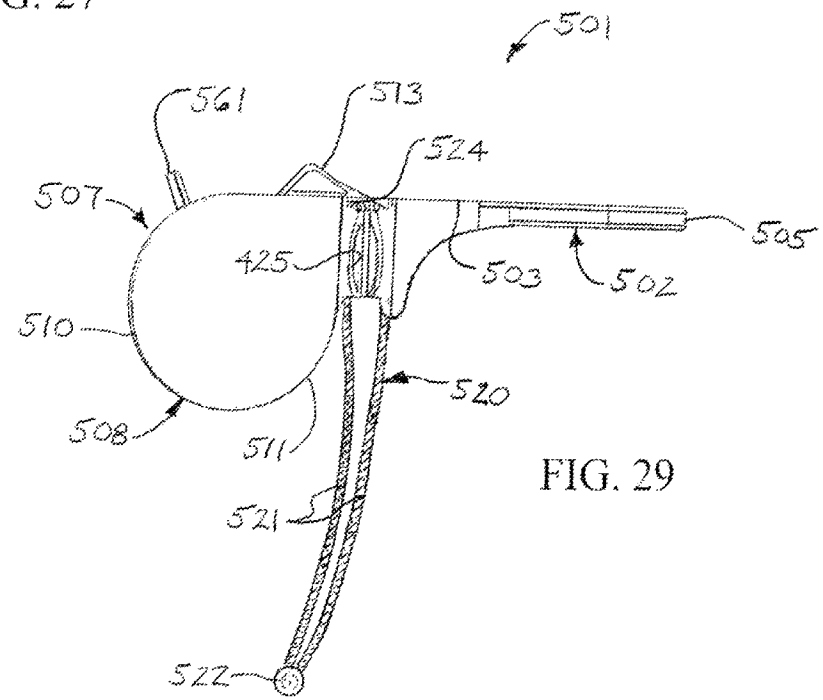
FIG. 29 is a right side view of the illustrative tape cutting device illustrated in FIG. 27, with the retainer mechanism deployed in an unfastened position on the tape cutting unit.
Figure 31:
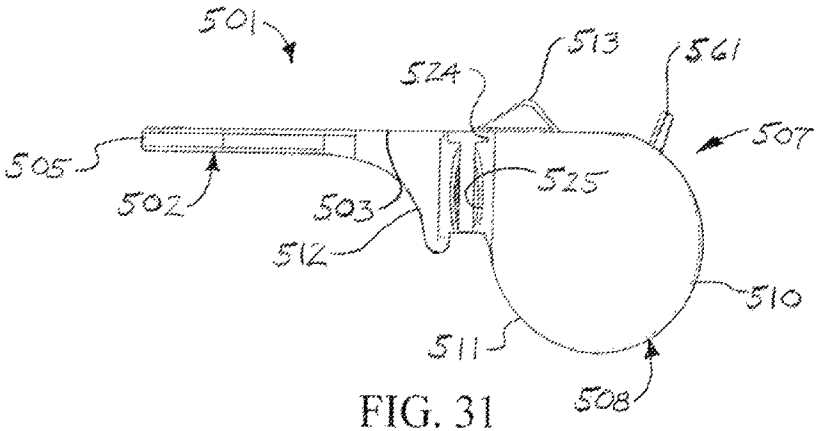
FIG. 31 is a right side view of the tape cutting unit of the illustrative tape cutting device illustrated in FIG. 27, with the retainer mechanism removed from the tape cutting unit.
Figure 33:
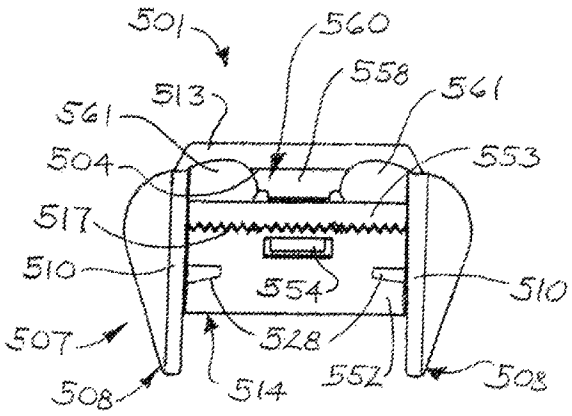
FIG. 33 is a front view of the tape cutting unit.
Figure 30:
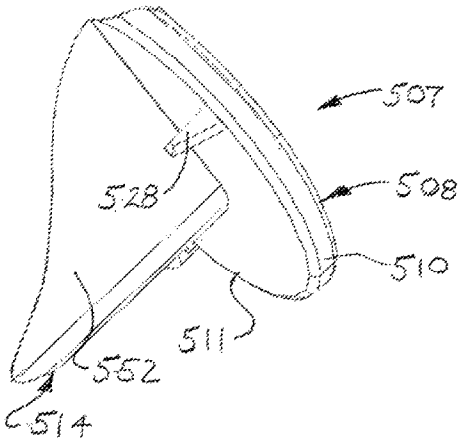
FIG. 30 is an enlarged sectional view, taken along section line 30 in FIG. 26.

In some embodiments, a pair of spaced-apart tape bending tabs 528 may extend toward each other from the inner surfaces of the respective tape roll guides 508. As illustrated in FIG. 28, the tape bending tabs 528 may be disposed beneath and in spaced-apart relationship to the tape cutting edge 517 of the tape cutting blade 514. The purpose of the tape bending tabs 528 will be hereinafter described.

As illustrated in FIGS. 26-29, the retainer mechanism 520 of the tape cutting device 501 may include at least one elastic retainer cord 521. At least one retainer member 522 may terminate the retainer cord 521. In some embodiments, the retainer member 522 may include a spherical bead. The retainer cord 521 may include a loop the ends of which are embedded in or attached to the retainer member 522 according to the knowledge of those skilled in the art.

Figure 34:
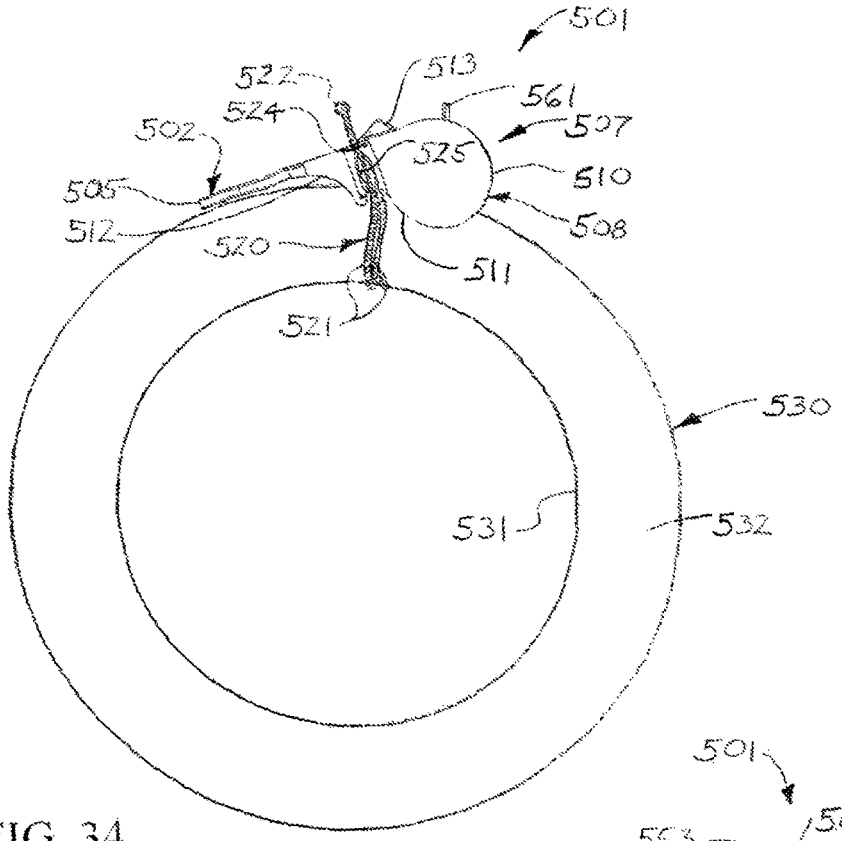
FIG. 34 is a side view of the illustrative tape cutting device of FIG. 27, secured on a tape roll in exemplary implementation of the device.
Figure 36A:
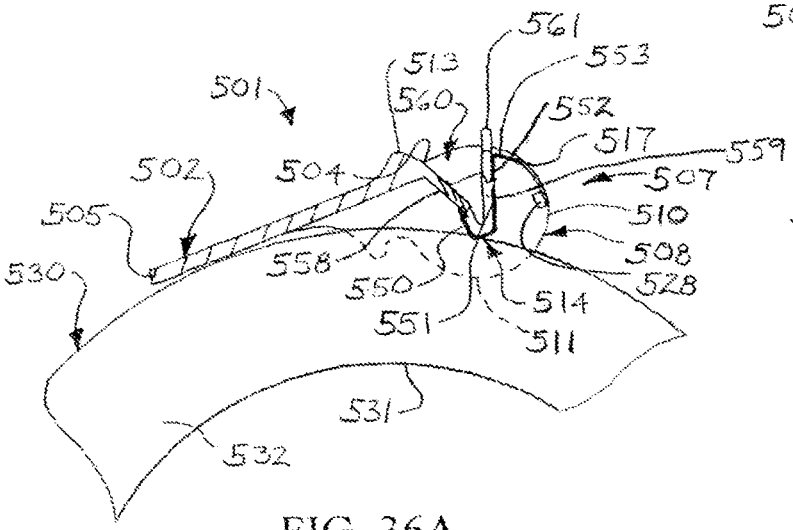
FIGS. 36A-36D are side views of the illustrative tape cutting device of FIG. 27 secured on the tape roll, more particularly illustrating a typical tape cutting sequence in exemplary application of the tape cutting device.
Figure 35:
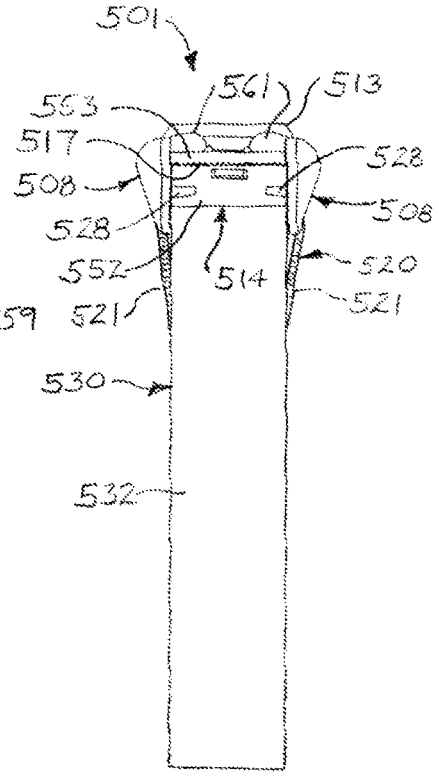
FIG. 35 is a front view of the illustrative tape cutting device of FIG. 27, secured on the tape roll in exemplary application of the tape cutting device.

As illustrated in FIGS. 34-36D, application of the tape cutting device 501 may be as was heretofore described with respect to the tape cutting device 1 in FIGS. 8-16. Accordingly, the tape cutting unit 507 is secured on the tape roll 530 by initially placing the spaced-apart tape roll guides 508 on opposite sides of the tape roll 530 with the tape roll engaging edge 505 of the device panel 502 engaging the outermost layer of the tape 532 wound on the spool 531 of the tape roll 530. As illustrated in FIG. 36A, the tape cutting edge 517 on the tape cutting blade 514 is initially disposed in spaced-apart relationship to the outermost layer of tape 532 on the tape roll 530. As illustrated in FIGS. 34 and 35, the retainer mechanism 520 secures the tape cutting unit 507 on the tape roll 530 by insertion of the retainer cord 521 through the retainer seats 524 and respective registering cord slits 525. In some applications, the retainer member 522 may be seated in the retainer seat 524 on one side of the device panel 502.

Figure 36B:
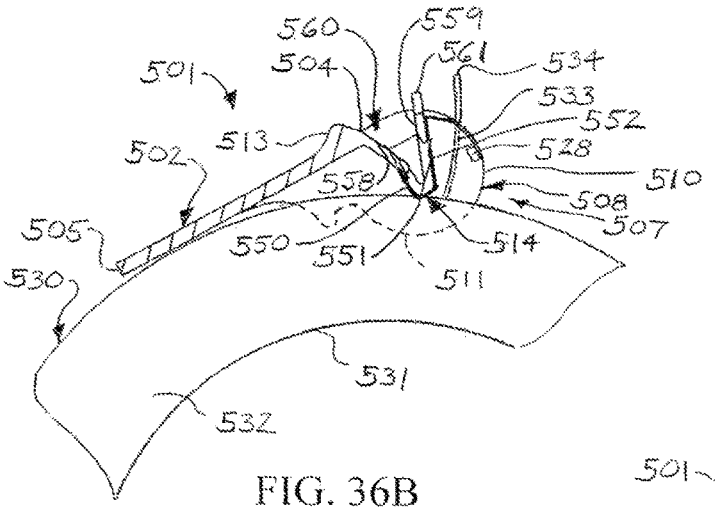
Figure 36C:
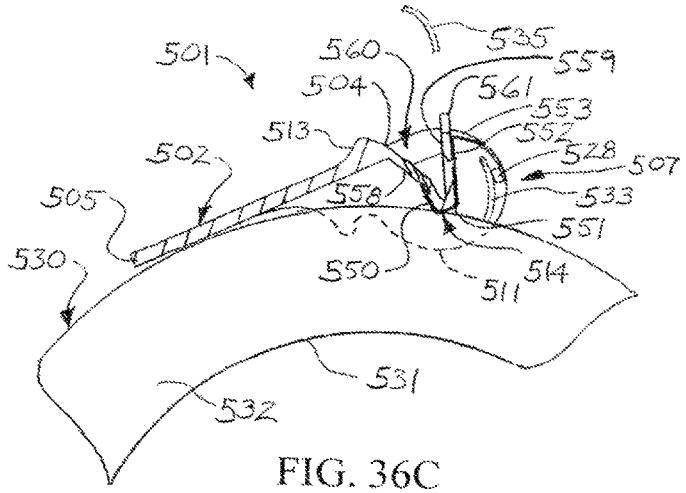
Figure 36D:
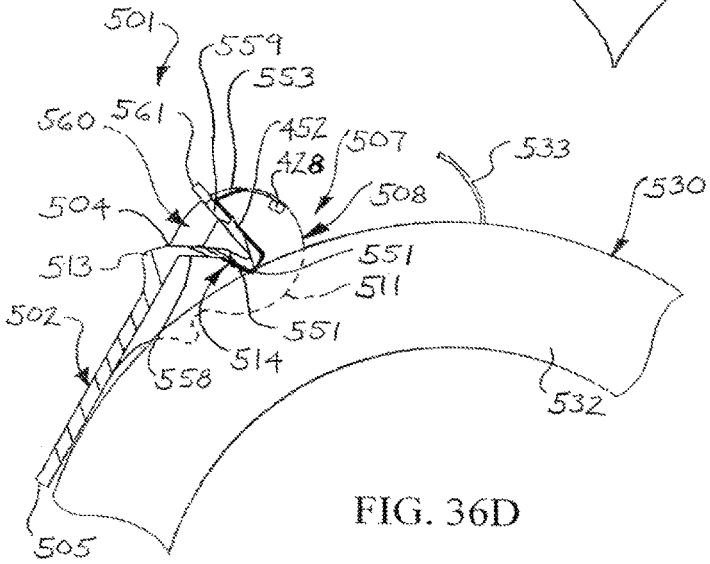

The tape cutting unit 507 is manually slid along the tape roll 530 until the tape cutting blade 514 is located behind and at a selected distance from the free end (not illustrated) of the tape 532, which distance corresponds to the desired length of the tape segment 533 to be cut from the tape 532. The free end of the tape 532 is next located and grasped, and the tape segment 533 which is to be removed is peeled from the underlying portion of the tape 532 wound on the spool 531. As it is removed from the underlying wound tape 532, the tape segment 533 is pulled against and across the tape cutting edge 517 of the tape cutting blade 514, as illustrated in FIG. 36B, such that the blade attachment edge 515 severs the tape segment 533 from the tape 532. The tape cutting edge 517 of the tape cutting blade 514 cuts a straight edge 534 in the tape segment 533 as well as facilitates the cutting of multiple tape segments 533 of selected and uniform or consistent length. The tape cutting device 1 may be subsequently displaced rearwardly on the tape roll 530 by insertion of the user's fingers into the panel gap 560 and/or by grasping the thumb flange 513. The finger guards 561 may protect the user's fingers from contacting the tape cutting blade 514. As illustrated in FIGS. 36C and 36D, upon subsequent rearward displacement of the tape cutting device 501 on the tape roll 530, the tape bending tabs 528 which protrude toward each other from the respective tape roll guides 508 beneath the tape cutting edge 517 may "catch" or engage and pull back the portion of the tape segment 533 which remains attached to the tape roll 530. Thus, the pulled-back tape segment 533 assists the user in finding, grasping and subsequently pulling and cutting the next tape segment 533 from the tape roll 530. The next tape segment 533 can be removed from the tape roll 530 in the similar manner, by positioning the tape cutting device 501 on the tape roll 530 behind and within the distance to the extending tape segment 533 which corresponds to the desired length of the tape segment 533 and then grasping and pulling the tape segment 533 against the tape cutting edge 517 of the tape cutting blade 514 to form the severed tape segment 535 (FIG. 36C), as was heretofore described.

As the tape segments 533 are cut and dispensed from the tape roll 530, the tape cutting device 501 is pushed or "rides" along the tape roll 530 to position the tape cutting edge 517 of the tape cutting blade 514 at the selected positions along the tape 532 for cutting and dispensing of the tape segments 533 of selected length. Throughout use of the tape cutting device 501, the elastic retainer cord 521 of the retainer mechanism 520 is constantly in a contracted state and thus, continually maintains a secure and snug fit of the tape cutting unit 507 against the tape roll 530. Therefore, as the diameter of the tape roll 530 progressively decreases as a result of the tape 532 being gradually dispensed from the spool 531, as was heretofore described with respect to FIGS. 14-16, the retainer cord 521 contracts and continues to snugly secure the tape cutting unit 507 on the tape roll 530 and prevents loosening of the tape cutting unit 507. The retainer mechanism 520 can be selectively tightened, as necessary, by pulling the retainer cord 521 upwardly in the cord slit 525 in the tape cutting unit 507. When all of the tape 532 has been dispensed from the spool 531, the tape cutting unit 507 can be removed from the spool 531 by disengaging the retainer member 522 from the retainer seat 524 in the device panel 502 and removing the retainer cord 521 from one or both of the cord slits 525. The tape cutting device 501 can be subsequently used in a similar manner on a fresh tape roll 530.

Figure 37:
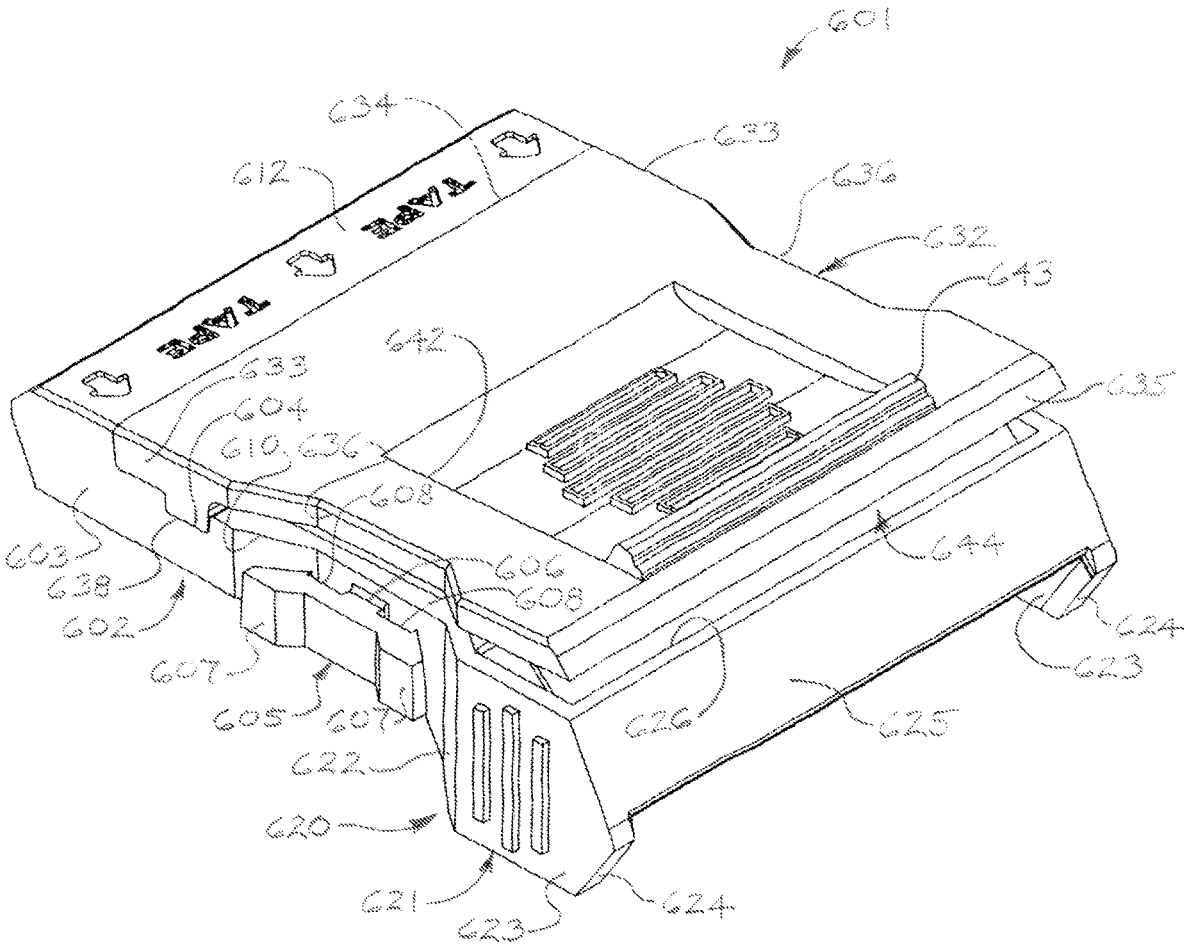
FIG. 37 is a front perspective view of another alternative illustrative embodiment of the tape cutting device.
Figure 38:
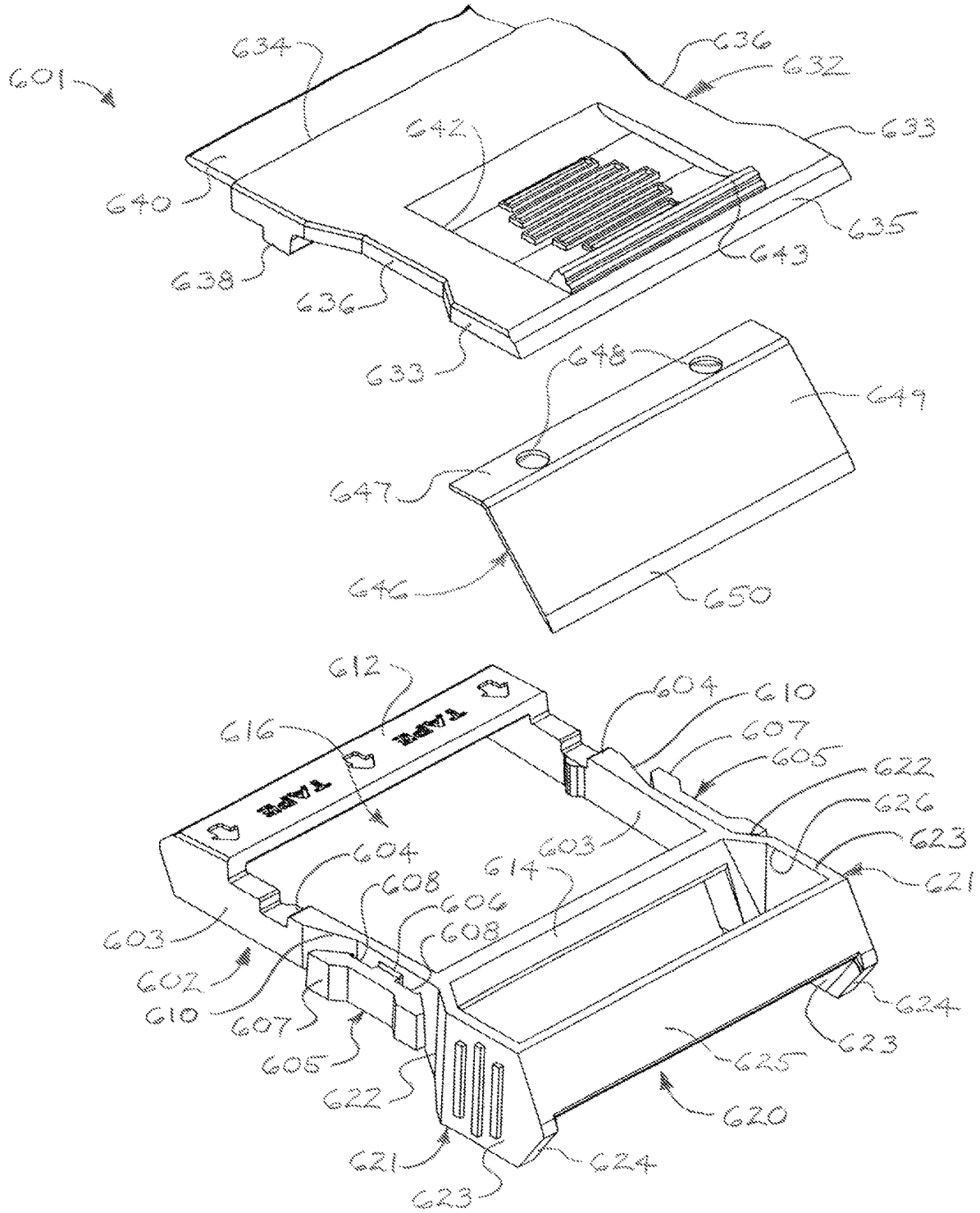
FIG. 38 is an exploded front perspective view of the illustrative tape cutting device illustrated in FIG. 37.
Figure 39:
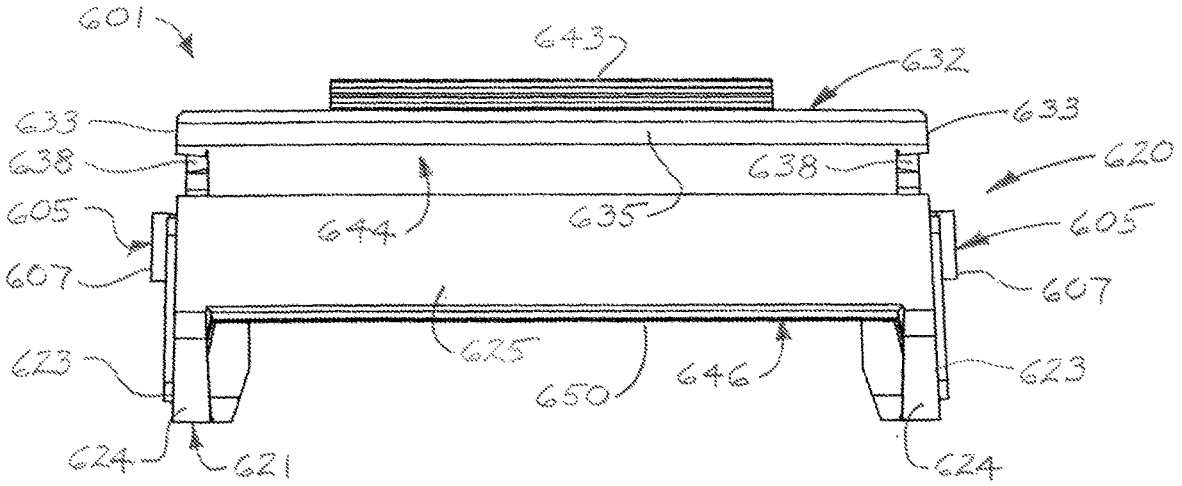
FIG. 39 is a front view of the illustrative tape cutting device illustrated in FIG. 37, with the tape cutting blade of the device shown in a retracted blade position.
Figure 40:
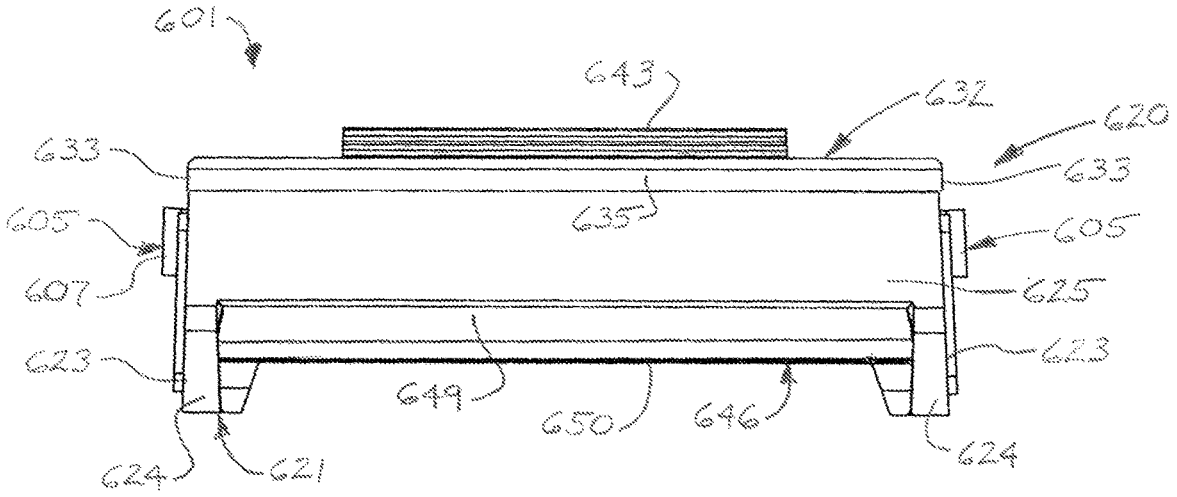
FIG. 40 is a front view of the illustrative tape cutting device illustrated in FIG. 37, with the tape cutting blade of the device shown in an extended blade position.
Figure 41:
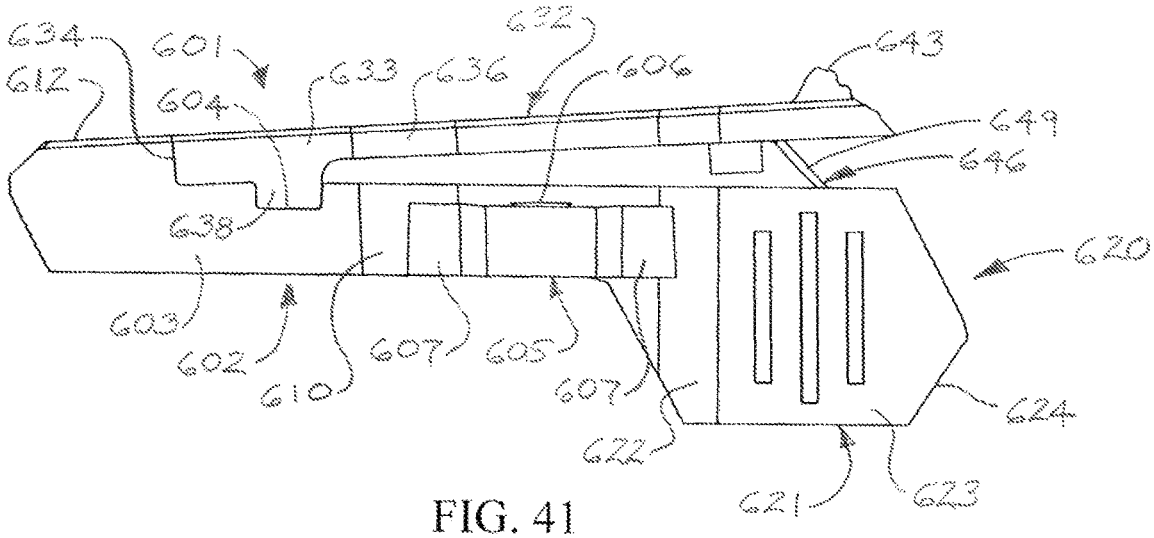
FIG. 41 is a right side view of the illustrative tape cutting device illustrated in FIG. 37, with the tape cutting blade of the device shown in the retracted blade position.
Figure 42:
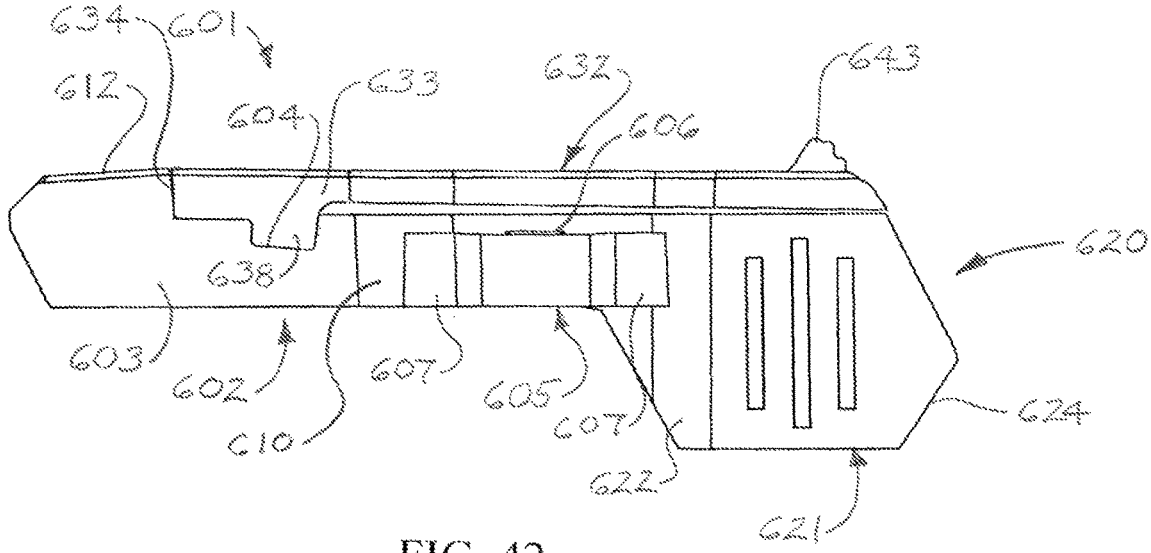
FIG. 42 is a left side view of the illustrative tape cutting device illustrated in FIG. 37, with the tape cutting blade of the device shown in the extended blade position.
Figure 43:
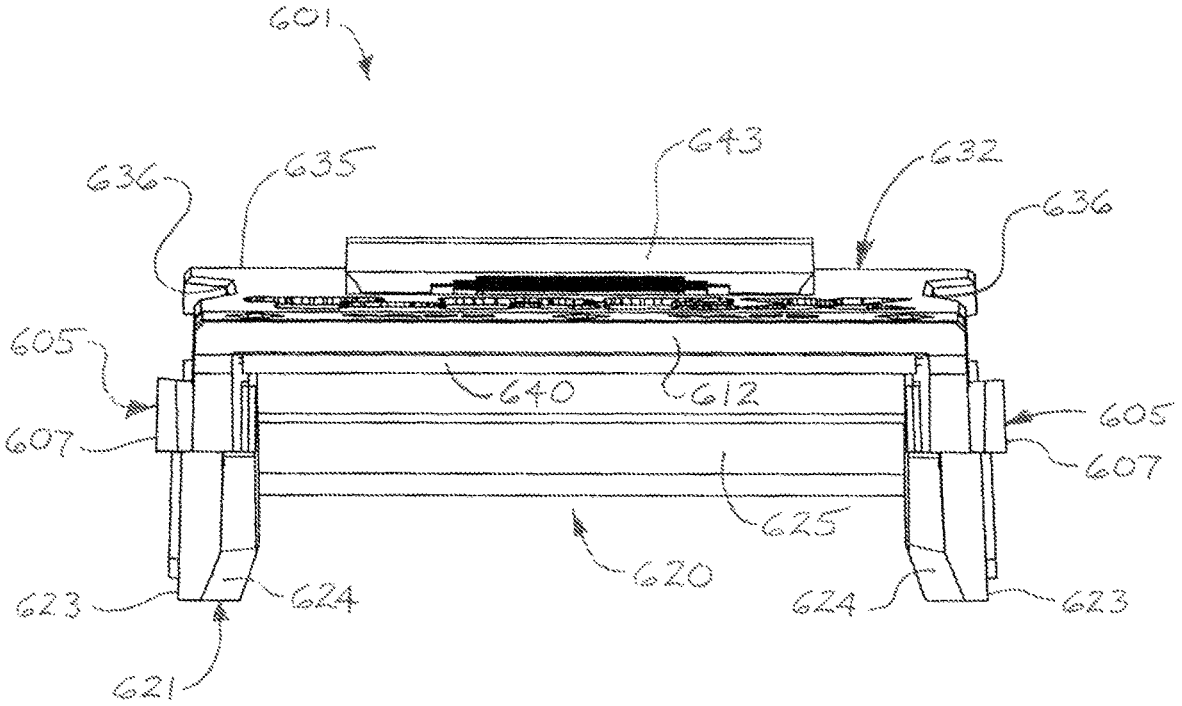
FIG. 43 is a rear view of the illustrative tape cutting device illustrated in FIG. 37.

Referring next to FIGS. 37-45 of the drawings, an alternative illustrative embodiment of the tape cutting device is generally indicated by reference numeral 601. As illustrated in FIGS. 37 and 38, the tape cutting device 601 may include a device frame 602. A blade housing 620 having a blade space 626 may be provided on the device frame 602. A blade actuating panel 632 may be pivotally attached to the device frame 602. A tape cutting blade 646 may be provided on the blade actuating panel 632. Accordingly, responsive to pivoting of the blade actuating panel 632 on the device frame 602, the tape cutting blade 646 may be selectively deployable between a retracted blade position in the blade space 626 of the blade housing 620, as illustrated in FIGS. 39 and 41, and an extended blade position with respect to the blade space 626, as illustrated in FIGS. 40 and 42, for purposes which will be hereinafter described. Deployment of the tape cutting blade 646 in the retracted blade position in the blade space 626 of the blade housing 620 may provide safety advantages to users of the tape cutting device 601. Moreover, deployment of the tape cutting blade 646 in the extended blade position with respect to the blade space 626 may facilitate cutting of tape segments from a tape roll 660 having a tape spool 662 on which thick or cut-resistant tape 661 is wound.

As illustrated in FIG. 38, the device frame 602 may include a pair of generally elongated, parallel, spaced-apart device side frame members 603. A pair of panel notches 604 may be provided in upper surfaces of the respective side frame members 603 for purposes which will be hereinafter described. A pair of cord retainers 605 may be provided on side surfaces of the respective device side frame members 603. Each cord retainer 605 may include a retainer mount arm 606 which extends from a side surface of the corresponding side frame member 603. A pair of cord retainer arms 607 may extend from the retainer mount arm 606 in generally parallel relationship to the device side frame member 603. Accordingly, a cord retainer notch 608 may be formed by and between each cord retainer arm 607 and the corresponding device side frame member 603 for purposes which will be hereinafter described. In some embodiments, a side arm notch 610 may be provided in a side surface of each device side frame member 603. Each cord retainer 605 may extend from each device side frame member 603 into the corresponding side arm notch 610.

A rear transverse frame member 612 may extend between the device side frame members 603. A front transverse frame member 614 may extend between the device side frame members 603 in generally parallel, spaced-apart relationship to the rear transverse frame member 612. A frame opening 616 may be formed by and between the device side frame members 603, the rear transverse frame member 612 and the front transverse frame member 614.

As further illustrated in FIG. 38, a blade housing 620 may be provided on the device frame 602. The blade housing 620 may include a pair of spaced-apart tape roll guides 621 which may extend from the respective device side frame members 603 beyond the front transverse frame member 614. A transverse housing member 625 may extend between the tape roll guides 621 in generally parallel, spaced-apart relationship to the front transverse frame member 614 of the device frame 602. In some embodiments, each tape roll guide 621 may have a rear guide segment 622 which extends from and outwardly at an angle with respect to the corresponding device side frame member 603 and a front guide segment 623 which extends from and at an obtuse angle with respect to the rear guide segment 622. The front guide segments 623 of the respective tape roll guides 621 may be disposed in parallel, spaced-apart relationship to each other. The transverse housing member 625 may extend between the front guide segments 623. The front guide segment 623 of each tape roll guide 621 may have a guide bevel 624. A blade space 626 may be formed by and between the front transverse frame member 614 of the device frame 602 and the tape roll guides 621 and the transverse housing member 625 of the blade housing 620.

The blade actuating panel 632 may include a pair of spaced-apart side panel edges 633. A rear panel edge 634 and a front panel edge 635 may extend between the side panel edges 633. A pair of side panel notches 636 may be provided in the respective side panel edges 633. The side panel edges 636 may register with the respective side arm notches 610 in the device side frame members 603 of the device frame 602. At least one thumb depression 642 may be provided in the upper surface of the blade actuating panel 632 behind the front panel edge 635. Additionally or alternatively, at least one thumb tab 643 may be provided on the upper surface of the blade actuating panel 632 for purposes which will be hereinafter described.

Figure 4:
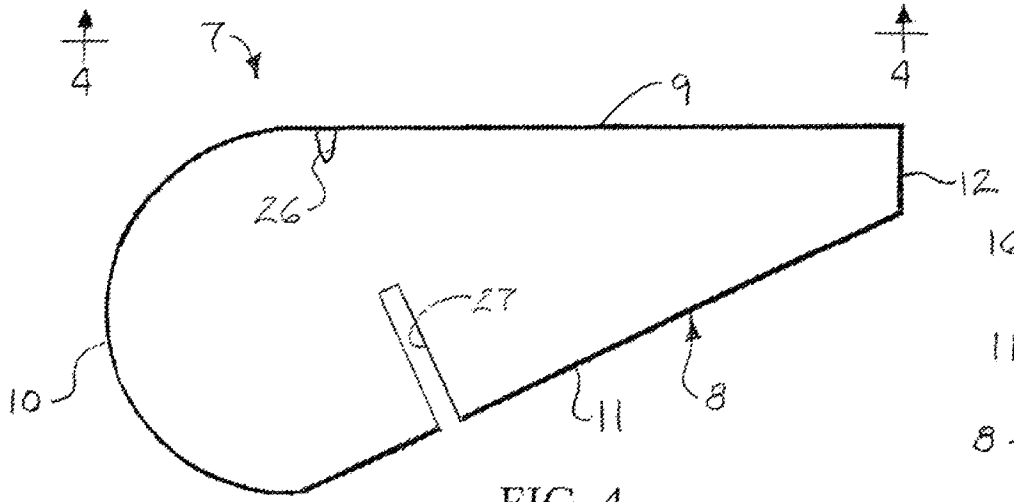
FIG. 4 is a side view, taken along side lines 4-4 in FIG. 3, of an exemplary tape cutting unit.
Figure 6:
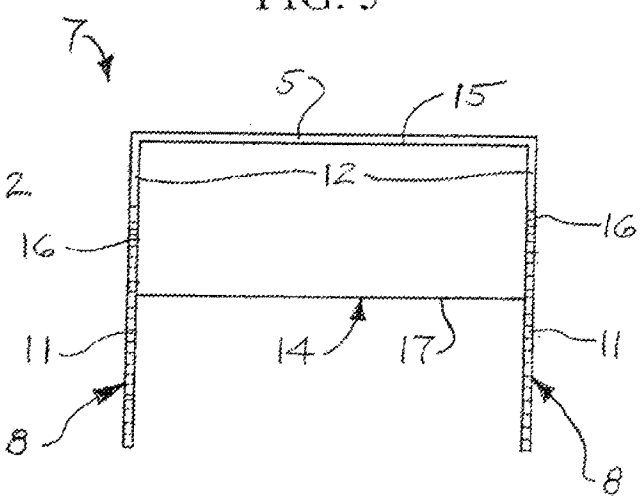
FIG. 6 is a rear view, taken along section lines 6-6 in FIG. 3, of an exemplary tape cutting unit.

At least one panel mount member 638 may extend from a lower surface of the blade actuating panel 632. In mounting of the blade actuating panel 632 on the device frame 602, as illustrated in FIGS. 41 and 42, the panel mount members 638 may mesh with the panel notches 604 in the respective device side frame members 603 of the device frame 602. As further illustrated in FIG. 38, a panel mount flange 640 may extend from the rear panel edge 634 of the blade actuating panel 632. The panel mount flange 640 may insert beneath the rear transverse frame member 612 of the device frame 602. Accordingly, the panel mount members 638 in the respective panel notches 604 of the device side frame members 603 may normally bias the blade actuating panel 632 and tape cutting blade 646 away from the blade housing 620 such that the tape cutting blade 646 is deployed in the retracted position inside the blade space 626 of the blade housing 620, as illustrated in FIGS. 39 and 41. The blade actuating panel 632 can be pressed toward and against the blade housing 620 at the thumb depression 642 or thumb tab 643 to deploy the tape cutting blade 646 in the extended blade position from the blade housing 620, as illustrated in FIGS. 40 and 4, against the bias imparted by the panel mount member or members 638. In the retracted blade position of the tape cutting blade 646, a panel space 644 may be formed between the blade actuating panel 632 and the transverse housing member 625 of the blade housing 620, as further illustrated in FIGS. 39 and 41.

Figure 44:
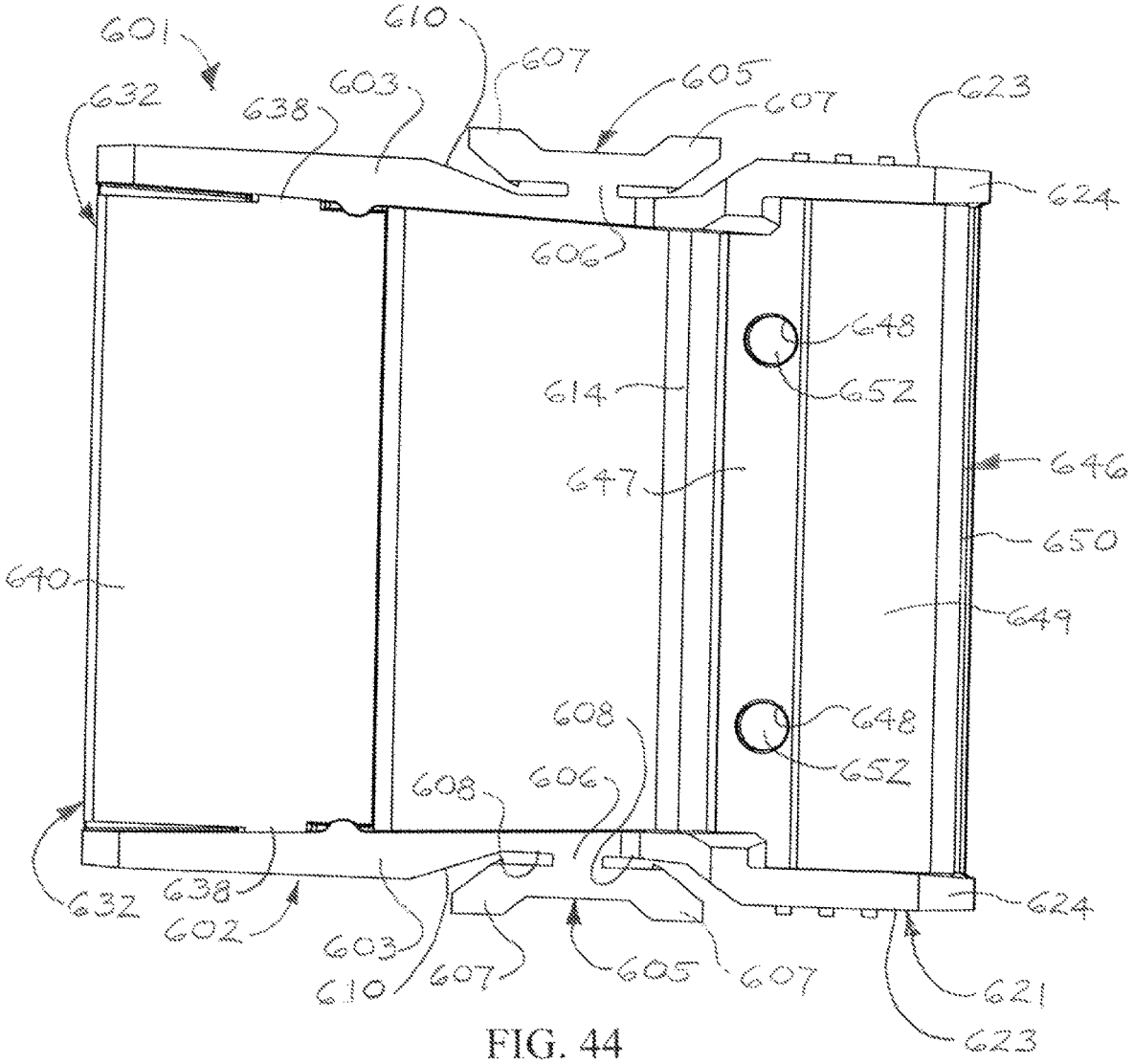
FIG. 44 is a bottom view of the illustrative tape cutting device illustrated in FIG. 37.

As illustrated in FIGS. 38 and 44, the tape cutting blade 646 may have a blade mount segment 647. At least one fastener opening 648 may extend through the blade mount segment 647. A main blade segment 649 may extend at an angle from the blade mount segment 647. A cutting edge 650 may extend along the main blade segment 649 opposite the blade mount segment 647. The tape cutting blade 646 may be mounted to the blade actuating panel 632 by extending panel fasteners 652 (FIG. 44) through the respective fastener openings 648 in the blade mount segment 647 and threading the panel fasteners 652 into registering fastener openings (not illustrated) in the lower surface of the blade actuating panel 632. Alternative fastening techniques known by those skilled in the art may be used for the purpose. Accordingly, when the blade actuating panel 632 is mounted in place on the device frame 602, as was heretofore described with respect to FIGS. 41 and 42, the tape cutting blade 646 may extend into the blade space 626 in the blade housing 620.

Figure 45:
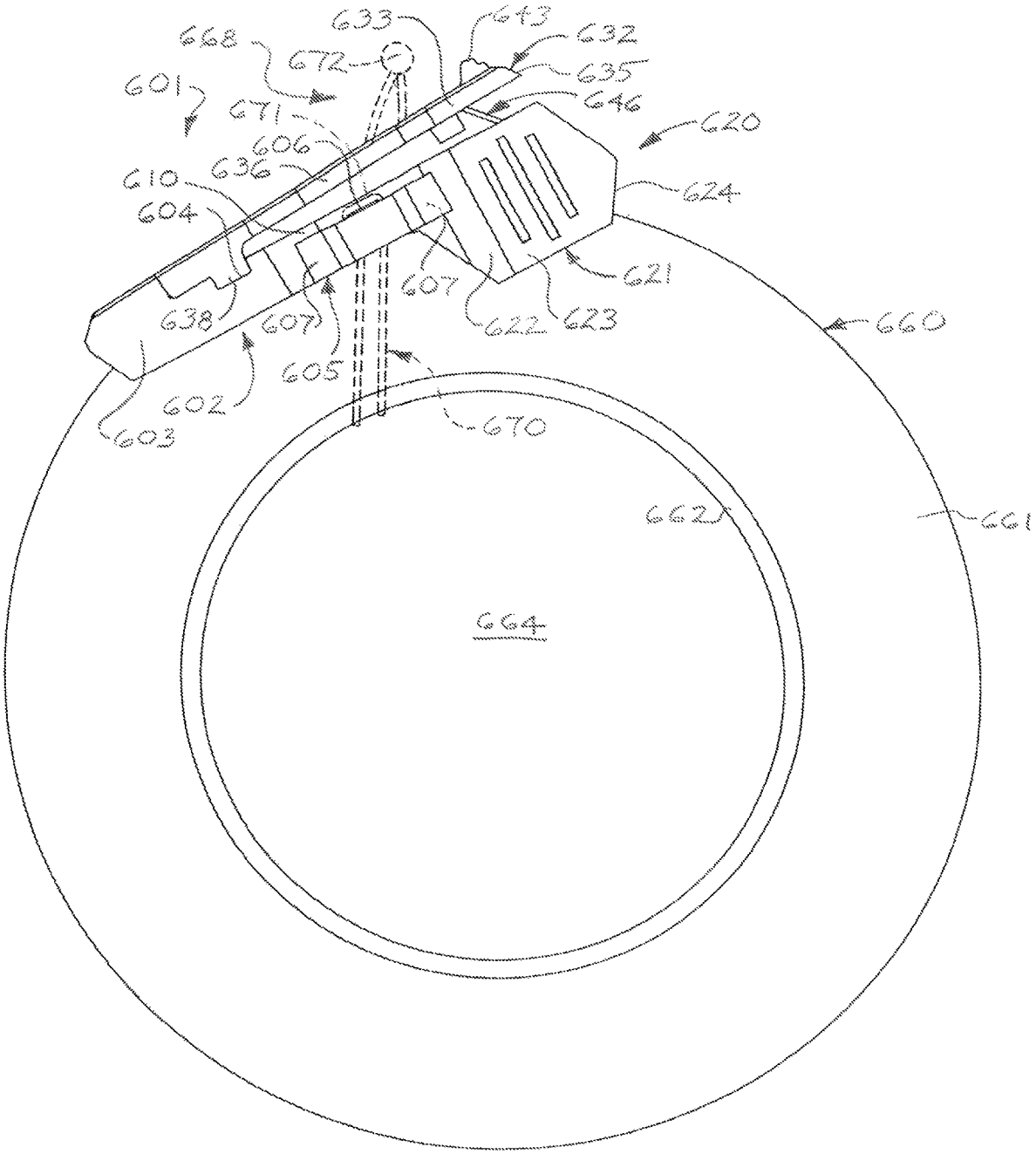
FIG. 45 is a right side view of the illustrative tape cutting device illustrated in FIG. 37, secured on a roll of tape in exemplary application of the tape cutting device.

As illustrated in FIG. 45, in typical application, the tape cutting device 601 may be secured on a tape roll 660 by initially placing the spaced-apart tape roll guides 621 on opposite sides of the tape roll 660. The tape cutting blade 646 may initially be deployed in the retracted blade position illustrated in FIGS. 39 and 41 such that the cutting edge 650 disengages the outermost layer of tape 661 which is wound on a tape spool 662 of the tape roll 660. A retainer mechanism 668 may be used to secure the tape cutting device 601 on the tape roll 660. In some embodiments, the retainer mechanism 668 may include an elastic retainer cord 670 having a cord loop 671 at one end and a cord bead 672 at the other end. The retainer mechanism 668 may secure the tape cutting device 601 on the tape roll 660 by insertion of the retainer cord 670 through the cord retainer notches 608 (FIG. 37) and engaging the cord loop 671 in the retainer cord 670 against the retainer mount arm 606 of one of the cord retainers 605. The cord bead 672 may then be extended through the spool opening 664 to the other side of the tape spool 662 and the retainer cord 670 inserted into the cord retainer notches 608 of the other cord retainer 605. The retainer cord 670 may be tightened by pulling the cord bead 672 away from the tape roll 660.

The tape cutting device 601 may be slid along the tape roll 660 until the tape cutting blade 646 is located at a selected distance from the free end (not illustrated) of the tape 661, which distance corresponds to the desired length of the tape segment to be cut from the tape 661. The blade actuating panel 632 may next be pivoted toward the device frame 602, typically by application of manual pressure on the thumb depression 642 and/or the thumb tab 643. Accordingly, the tape cutting blade 646 may be deployed from the retracted blade position illustrated in FIGS. 39 and 41 to the extended blade position illustrated in FIGS. 40 and 42 as the panel space 644 between the blade actuating panel 632 and the transverse housing member 625 of the blade housing 620 is closed, as further illustrated in FIGS. 40 and 42. Thus, the tape cutting edge 650 on the tape cutting blade 646 may engage the outermost layer of tape 661 against the underlying layers of tape 661 on the tape roll 660. The free end of the tape 661 may next be located and grasped, and the tape segment which is to be removed peeled from the underlying portion of the tape 661 wound on the tape spool 662. As it is removed from the underlying wound tape 661, the tape segment may be pulled against and across the tape cutting edge 650 of the tape cutting blade 646 such that the tape cutting edge 650 severs the tape segment from the tape 661. It will be appreciated by those skilled in the art that the tape cutting edge 650 of the tape cutting blade 646 may cut a straight edge in the tape segment as well as multiple tape segments of selected and uniform or consistent length. After the severed tape segment is removed from the tape roll 660, manual pressure on the blade actuating panel 632 may be released such that the blade actuating panel 632 and the tape cutting blade 646 return to the retracted position of FIGS. 39 and 41. Thus, the tape cutting blade 646 may be safety deployed in the blade space 626 in the blade housing 620.

As the tape segments are cut and dispensed from the tape roll 660, the tape cutting device 601 is pushed or "rides" along the tape roll 660 to position the tape cutting edge 650 of the tape cutting blade 646 at the selected positions along the tape 661 for cutting and dispensing of the tape segments of selected length. Throughout use of the tape cutting device 601, the elastic retainer cord 670 of the retainer mechanism 668 may constantly be in a contracted state and thus, continually maintain a secure and snug fit of the tape cutting device 601 against the tape roll 660. Therefore, as the diameter of the tape roll 660 progressively decreases as a result of the tape 661 being gradually dispensed from the tape spool 662, the retainer cord 670 may contract and continue to snugly secure the tape cutting device 601 on the tape roll 660 and prevent loosening of the tape cutting device 601. As the diameter of the tape roll 660 decreases, the retainer cord 670 may continue to engage the inner surface of the tape spool 662. When all of the tape 661 has been dispensed from the tape spool 662, the tape cutting device 601 can be removed from the tape spool 662 typically by disengaging the retainer cord 670 from the cord retainer notches 608 on the side corresponding to the cord bead 672 and removing the retainer cord 670. The tape cutting device 601 can be subsequently used in a similar manner on a fresh tape roll 660.

While the illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A tape cutting device for cutting tape segments from tape wound on a tape roll, comprising:

a device frame adapted to ride along the tape roll, the device frame including:

a pair of generally elongated, parallel, spaced-apart device side frame members;

a rear transverse frame member extending between the device side frame members;

a front transverse flame member extending between the device side frame members in generally parallel, spaced-apart relationship to the rear transverse frame member; and a frame opening formed by and between the device side frame members, the rear transverse frame member and the front transverse frame member;

a blade housing carried by the device frame, the blade housing having a pair of spaced-apart tape roll guides extending from the device side frame members, respectively, a transverse housing member extending between the tape roll guides and a blade space formed by and between the front transverse frame member of the device frame, the tape roll guides and the transverse housing member of the blade housing;

a blade actuating panel pivotally carried by the device frame;

a tape cutting blade having a tape cutting edge carried by the blade actuating panel, the tape cutting blade selectively deployable between a retracted position in the blade space and an extended position with respect to the blade space of the blade housing responsive to pivoting of the blade actuating panel on the device frame;

a pair of cord retainers carried by the device side frame members, respectively, each of the pair of cord retainers having a pair of cord retainer notches; and a retaining mechanism carried by the device frame, the retaining mechanism having a retainer cord adapted to extend through the pair of cord retainer notches of each of the pair of cord retainers to secure the device frame on the tape roll.

2. The tape cutting device of claim 1 further comprising a panel mount flange extending from the blade actuating panel, the panel mount flange inserts beneath the rear transverse frame member of the device frame to pivotally mount the blade actuating panel on the device frame.

3. The tape cutting device of claim 2 further comprising at least one panel mount member carried by the blade actuating panel and engaging the device frame, and wherein the at least one panel mount member normally biases the blade actuating panel in the retracted blade position.

4. The tape cutting device of claim 3 further comprising at least one panel notch in at least one of the pair of device side frame members of the device frame and receiving the at least one panel mount member.

5. The tape cutting device of claim 1 wherein the blade actuating panel comprises a pair of spaced-apart side panel edges and a rear panel edge and a front panel edge extending between the side panel edges, and wherein the blade actuating panel is pivotally carried by the device frame at the rear panel edge and the tape cutting blade is carried by the blade actuating panel at the front panel edge.

6. The tape cutting device of claim 1 further comprising at least one thumb depression in the blade actuating panel.

7. The tape cutting device of claim 1 further comprising at least one thumb tab on the blade actuating panel.

8. A tape cutting device for cutting tape segments from tape wound on a tape roll, comprising:

a device frame adapted to ride along the tape roll, the device frame including:

a pair of generally elongated, parallel, spaced-apart device side frame members;

a pair of panel notches provided in the device side frame members, respectively;

a pair of side arm notches provided in the device side frame members, respectively;

a rear transverse frame member extending between the device side frame members;

a front transverse frame member extending between the device side frame members in generally parallel, spaced-apart relationship to the rear transverse frame member;

a frame opening formed by and between the device side frame members, the rear transverse frame member and the front transverse frame member;

a blade housing carried by the device frame, the blade housing having a pair of spaced-apart tape roll guides extending from the device side frame members, respectively, of the device frame, a transverse housing member extending between the tape roll guides and a blade space formed by and between the front transverse frame member of the device frame, the tape roll guides and the transverse housing member of the blade housing;

a blade actuating panel pivotally carried by the device frame, the blade actuating panel having a pair of spaced-apart side panel edges and a rear panel edge and a front panel edge extending between the side panel edges;

a panel mount flange extending from the rear panel edge of the blade actuating panel, the panel mount flange inserts beneath the rear transverse frame member of the device frame to pivotally mount the blade actuating panel on the device frame;

at least one panel mount member carried by the blade actuating panel and engaging pair of panel notches provided in the device side frame members, respectively of the device frame, and wherein the at least one panel mount member normally biases the blade actuating panel in a retracted position;

a tape cutting blade having a tape cutting edge carried by the blade actuating panel at the front panel edge, the tape cutting blade selectively deployable between the retracted position in the blade space of the blade housing and an extended blade position responsive to pivoting of the blade actuating panel on the device frame;

a pair of cord retainers carried by the device side frame members, respectively, of the device frame, each of the pair of cord retainers having a pair of cord retainer notches; and a retaining mechanism carried by the device frame, the retaining mechanism having a retainer cord adapted to extend through the pair of cord retainer notches of each of the pair of cord retainers to secure the device frame on the tape roll.

9. The tape cutting device of claim 8 wherein each of the pair of tape roll guides comprises a rear guide segment extending from and outwardly at an angle with respect to each corresponding one of the pair of device side frame members and a front guide segment extending from and at an obtuse angle with respect to the rear guide segment.

10. The tape cutting device of claim 9 further comprising a guide bevel in the front guide segment.

11. The tape cutting device of claim 8 further comprising a thumb depression in the blade actuating panel and at least one thumb tab on the blade actuating panel.

12. The tape cutting device of claim 8 wherein each of the pair of cord retainers comprises a retainer mount arm extending from a side surface of each corresponding one of the pair of device side frame members and a pair of cord retainer arms extending from the retainer mount arm in generally parallel relationship to the corresponding one of the pair of device side frame members, and wherein the pair of cord retainer notches is formed by and between each corresponding one of the pair of cord retainer arms and each corresponding one of the pair of device side frame members.

* * * * *